US009636907B2

(12) United States Patent
Shinkawa et al.

(10) Patent No.: US 9,636,907 B2
(45) Date of Patent: May 2, 2017

(54) LIQUID DISCHARGE APPARATUS, CONTROL METHOD OF LIQUID DISCHARGE APPARATUS, AND CONTROL PROGRAM OF LIQUID DISCHARGE APPARATUS

(71) Applicant: SEIKO EPSON CORPORATION, Tokyo (JP)

(72) Inventors: Osamu Shinkawa, Nagano (JP); Toshiyuki Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/991,153

(22) Filed: Jan. 8, 2016

(65) Prior Publication Data

US 2016/0279929 A1 Sep. 29, 2016

(30) Foreign Application Priority Data

Mar. 27, 2015 (JP) ..... 2015-065458

(51) Int. Cl.

| | |
|---|---|
| ***B41J 2/045*** | (2006.01) |
| ***B41J 2/165*** | (2006.01) |
| ***B41J 2/21*** | (2006.01) |
| *B41J 2/14* | (2006.01) |

(52) U.S. Cl.

CPC ..... *B41J 2/0451* (2013.01); *B41J 2/04541* (2013.01); *B41J 2/04581* (2013.01); *B41J 2/04588* (2013.01); *B41J 2/04593* (2013.01); *B41J 2/04596* (2013.01); *B41J 2/16579* (2013.01); *B41J 2/2142* (2013.01); *B41J 2002/14354* (2013.01)

(58) Field of Classification Search

USPC ..... 347/19

See application file for complete search history.

(56) References Cited

U.S. PATENT DOCUMENTS

2004/0223027 A1 11/2004 Shinkawa et al.
2006/0071964 A1* 4/2006 Oku ..... B41J 2/0451 347/19
2007/0103500 A1* 5/2007 Ootsuka ..... B41J 2/0451 347/19

(Continued)

FOREIGN PATENT DOCUMENTS

JP 2004-276544 A 10/2004

*Primary Examiner* — Shelby Fidler
(74) *Attorney, Agent, or Firm* — Global IP Counselors, LLP

(57) ABSTRACT

A liquid discharge apparatus includes a discharge unit including a piezoelectric element that is displaced in response to a drive signal, a pressure chamber of which an inner pressure is increased or decreased by the piezoelectric element, and a nozzle which is in communication with the pressure chamber and discharges liquid filling the pressure chamber, depending on an increase or a decrease in the inner pressure of the pressure chamber, a detection unit that detects residual vibration occurring in the discharge unit according to a potential change of the drive signal that is supplied to the piezoelectric element, and a determination unit that determines a discharge state, in which the detection unit outputs a first detection signal and a second detection signal, and the determination unit determines the discharge state, based on the first detection signal and the second detection signal.

9 Claims, 17 Drawing Sheets

(56) References Cited

U.S. PATENT DOCUMENTS

| | | | | |
|---|---|---|---|---|
| 2008/0030102 | A1* | 2/2008 | Ohnishi | B41J 2/0451<br>310/317 |
| 2011/0285775 | A1* | 11/2011 | Shinkawa | B41J 2/16526<br>347/14 |
| 2013/0187975 | A1* | 7/2013 | Kitazawa | B41J 2/12<br>347/19 |

* cited by examiner

EXPERIMENTAL VALUE AND CALCULATED VALUE OF RESIDUAL VIBRATION (NORMAL STATE)

EXPERIMENTAL VALUE AND CALCULATED VALUE OF RESIDUAL VIBRATION (DRIED)

EXPERIMENTAL VALUE AND CALCULATED VALUE OF RESIDUAL VIBRATION (PAPER DUST)

| | SI[m] (b1, b2) | Ts1 | | Ts2 | |
|---|---|---|---|---|---|
| | | Sa[m] | Sb[m] | Sa[m] | Sb[m] |
| LARGE DOT | (1, 1) | H | L | H | L |
| MEDIUM DOT | (1, 0) | H | L | L | H |
| SMALL DOT | (0, 1) | L | H | H | L |
| NON-RECORDING | (0, 0) | L | H | L | H |

LIQUID DISCHARGE APPARATUS, CONTROL METHOD OF LIQUID DISCHARGE APPARATUS, AND CONTROL PROGRAM OF LIQUID DISCHARGE APPARATUS

This application claims priority to Japanese Patent Application No. 2015-065458 filed on Mar. 27, 2015. The entire disclosure of Japanese Patent Application No. 2015-065458 is hereby incorporated herein by reference.

BACKGROUND

1. Technical Field

The present invention relates to a liquid discharge apparatus, a control method of a liquid discharge apparatus, and a control program of a liquid discharge apparatus.

2. Related Art

A liquid discharge apparatus such as an ink jet printer forms an image on a recording medium, by driving a piezoelectric element provided in a discharge unit using a drive signal, and displacing the piezoelectric element so as to discharge liquid such as ink filling the cavity (a pressure chamber) of the discharge unit. In such a liquid discharge apparatus, abnormal discharge may occur, in which the discharge unit is not able to properly discharge the liquid, due to thickening of liquid, or bubble mixing into a cavity. Then, if the abnormal discharge occurs, it is not able to exactly form dots to be formed on a medium by using the liquid discharged from the discharge unit, and thus the quality of the image formed by the liquid discharge apparatus is reduced.

JP-A-2004-276544 proposes a technique for preventing deterioration in an image quality due to abnormal discharge, by detecting residual vibration occurring in a discharge unit after a piezoelectric element is driven in response to a drive signal, and determining the discharge state of the liquid in the discharge unit, based on the characteristics of the residual vibration, such as the period and amplitude, and the like of the residual vibration.

However, with an increase in a print speed in recent years, an interval from when a piezoelectric element is driven in response to a drive signal to when the piezoelectric element is driven next becomes gradually shorter. When the driving interval of the piezoelectric element is reduced and the period of the drive signal is reduced, a detection period is shortened, which is a period provided for detecting residual vibration during one period of the drive signal, and a period in which the signal level of the drive signal is maintained at a certain level, or a fluctuation in the signal level of the drive signal is reduced, in order to accurately detect the residual vibration. Then, when the detection period is shortened, there is a high possibility that the detection accuracy of the residual vibration is reduced, or the detection result of the residual vibration does not include the amount of information to an extent capable of identifying the characteristics of the residual vibration. In this case, there is a problem in that the accuracy of the determination is likely to decrease in the determination of the discharge state based on the characteristics of residual vibration.

SUMMARY

An advantage of some aspects of the invention is to provide a technique for enabling determination of a discharge state of liquid from the discharge unit with high accuracy, even when it is not possible to ensure a sufficient period as the detection period for detecting residual vibration.

According to an aspect of the invention, a liquid discharge apparatus includes a discharge unit including a piezoelectric element that is displaced in response to a drive signal, a pressure chamber of which an inner pressure is increased or decreased by the piezoelectric element, and a nozzle which is in communication with the pressure chamber and discharges liquid filling the pressure chamber, depending on an increase or a decrease in the inner pressure of the pressure chamber; a detection unit that detects residual vibration occurring in the discharge unit according to a potential change of the drive signal that is supplied to the piezoelectric element; and a determination unit that determines a discharge state of the liquid in the discharge unit, depending on a detection result of the detection unit, in which the detection unit outputs a first detection signal indicating a detection result of residual vibration occurring in the discharge unit after a potential of the drive signal supplied to the piezoelectric element changes to a first potential from a potential different from the first potential, and a second detection signal indicating a detection result of residual vibration occurring in the discharge unit after the potential of the drive signal supplied to the piezoelectric element changes to a second potential from a potential different from the second potential, and in which the determination unit determines the discharge state of the liquid in the discharge unit, based on the first detection signal and the second detection signal.

In this case, since the discharge state is determined based on two detection signals of the first detection signal and the second detection signal, the accuracy of the determination of the discharge state may be improved, as compared with the case of determining the discharge state based on one detection signal.

According to another aspect of the invention, a liquid discharge apparatus includes a discharge unit including a piezoelectric element that is displaced in response to a drive signal, a pressure chamber of which an inner pressure is increased or decreased by the piezoelectric element, and a nozzle which is in communication with the pressure chamber and discharges liquid filling the pressure chamber, depending on an increase or a decrease in the inner pressure of the pressure chamber; a detection unit that outputs a first detection signal indicating a detection result of residual vibration occurring in the discharge unit in a first period, and a second detection signal indicating a detection result of residual vibration occurring in the discharge unit in a second period, when a drive signal is supplied to the piezoelectric element, the drive signal having a drive waveform which is a first potential in the first period and is a second potential in the second period; and a determination unit that determines a discharge state of liquid in the discharge unit, based on the first detection signal and the second detection signal.

In this case, since there are two detection periods of the first period and the second period, it is possible to increase a total duration of the period when the detection unit can detect the residual vibration, as compared with the case where there is one detection period. Therefore, it is possible to improve the detection accuracy of the residual vibration, or to increase the amount of information included in the detection result of the residual vibration by the detection unit. In other words, in this case, even if it is difficult to secure a detection period with a longer duration, for example, due to an improvement in the print speed, it is possible to accurately specify the characteristics of the residual vibration. Accordingly, as compared with the case where there is one detection period, it is possible to increase the accuracy of the determination of the discharge state based on the characteristics of residual vibration.

According to still another aspect of the invention, a liquid discharge apparatus may include a discharge unit including a piezoelectric element that is displaced in response to a drive signal, a pressure chamber of which an inner pressure is increased or decreased by the piezoelectric element, and a nozzle which is in communication with the pressure chamber and discharges liquid filling the inside of the pressure chamber, depending on an increase or a decrease in the inner pressure of the pressure chamber; a supply unit capable of supplying the drive signal to the piezoelectric element at each unit period; a detection unit that outputs a first detection signal indicating a detection result of residual vibration occurring in the discharge unit in a first period out of the unit periods, and a second detection signal indicating a detection result of residual vibration occurring in the discharge unit in the second period that starts after the end of the first period, out of the unit periods, when the drive signal is supplied to the piezoelectric element; and a determination unit that determines a discharge state of liquid in the discharge unit, based on the first detection signal and the second detection signal.

In the liquid discharge apparatus, the drive waveform may include a first waveform that changes to the first potential from a potential different from the first potential, prior to a start of the first period, and a second waveform that changes to the second potential from a potential different from the second potential, prior to a start of the second period after an end of the first period, in which the first detection signal may indicate a detection result of residual vibration caused by the first waveform occurring in the discharge unit, and the second detection signal may indicate a detection result of composite vibration of residual vibration caused by the first waveform occurring in the discharge unit, and residual vibration caused by the second waveform occurring in the discharge unit.

In this case, a composite vibration of the residual vibration caused by the first waveform and the residual vibration caused by the second waveform is detected in the second period. In other words, in this case, the residual vibration caused by the first waveform is detected in both the first period and the second period. Therefore, for example, as compared with the case where the residual vibration caused by the first waveform is detected in the first period, and the residual vibration caused by the second waveform in the second period, without detecting the residual vibration caused by the first waveform in the second period, in other words, as compared with the case where the residual vibration caused by the first waveform is sufficiently attenuated before the second period is started, it is possible to increase the amount of information that can be obtained from the detection result of the residual vibration caused by the first waveform. Thus, in this case, it is possible to determine the discharge state with high accuracy, based on the characteristics of the residual vibration.

Further, in the liquid discharge apparatus, at least one period of the first period and the second period may be shorter than a period of residual vibration occurring in the discharge unit, in the first period or the second period, if the discharge state of the liquid in the discharge unit is normal.

In this case, since the first period or the second period is shorter than the period of the residual vibration, even when the drive period of the discharge unit is short, it is possible to determine the discharge state, based on the characteristics of residual vibration.

Further, in this case, in particular, in the case of detecting a composite vibration of the residual vibration caused by the first waveform and the residual vibration caused by the second waveform in the second period, even if the first period is shorter than the period of the residual vibration, it is possible to analogize the period of the residual vibration caused by the first waveform, from the phase of the composite vibration of the residual vibration detected in the second period. That is, in this case, as compared with the case where the first period is longer than the period of the residual vibration, it is possible to prevent the amount of information that can be obtained from the detection result of the residual vibration caused by the first waveform from being greatly reduced.

Further, in the liquid discharge apparatus, the determination unit may determine the discharge state of the liquid in the discharge unit, depending on a phase of residual vibration indicated by the first detection signal, a magnitude of a change in a signal level indicated by the first detection signal, a phase of residual vibration indicated by the second detection signal, and a magnitude of a change in a signal level indicated by the second detection signal.

In this case, since the discharge state is determined according to the phase or signal level of the detected residual vibration, the first period or the second period is shorter than the period of the residual vibration, and even if it is not possible to directly specify the period and amplitude of the residual vibration from the detected residual vibration, it is possible to determine the discharge state.

Further, in the liquid discharge apparatus, when a drive signal having a waveform that changes to the first potential or the second potential is supplied to the piezoelectric element, the discharge unit may discharge liquid filling the pressure chamber from the nozzle.

In this case, when the waveform of the drive signal is a discharge waveform for discharging the liquid from the discharge unit, the residual vibration occurring in the discharge unit is detected. In other words, in this case, it is possible to simultaneously execute a printing process of forming an image on a medium by ejecting the liquid from the discharge unit, and a process of determining the discharge state based on the characteristics of the residual vibration occurring in the discharge unit. Accordingly, it is possible to perform determination of the discharge state without interrupting the printing process. Thus, it is possible to suppress a decrease in the convenience of the user of the liquid discharge apparatus, by performing the determination of the discharge state.

Further, according to still another aspect of the invention, a control method of a liquid discharge apparatus is provided, the liquid discharge apparatus including a discharge unit including a piezoelectric element that is displaced in response to a drive signal, a pressure chamber of which an inner pressure is increased or decreased by the piezoelectric element, and a nozzle which is in communication with the pressure chamber and discharges liquid filling the pressure chamber, depending on an increase or a decrease in the inner pressure of the pressure chamber. The control method includes detecting residual vibration occurring in the discharge unit after a potential of the drive signal supplied to the piezoelectric element is changed to a first potential from a potential different from the first potential; outputting a first detection signal representing the detection result; detecting residual vibration occurring in the discharge unit after the potential of the drive signal supplied to the piezoelectric element is changed to a second potential from a potential different from the second potential; outputting a second detection signal representing the detection result; and determining a discharge state of liquid in the discharge unit, based on the first detection signal and the second detection signal.

In this case, since a discharge state is determined based on two detection signals of the first detection signal and the second detection signal, it is possible to increase the accuracy of the determination of the discharge state, as compared with the case of determining the discharge state based on one detection signal.

Further, according to still another aspect of the invention, a control program of a liquid discharge apparatus is provided, the liquid discharge apparatus including a discharge unit including a piezoelectric element that is displaced in response to a drive signal, a pressure chamber of which an inner pressure is increased or decreased by the piezoelectric element, and a nozzle which is in communication with the pressure chamber and discharges liquid filling the pressure chamber, depending on an increase or a decrease in the inner pressure of the pressure chamber; a detection unit that detects residual vibration occurring in the discharge unit according to a potential change of the drive signal that is supplied to the piezoelectric element; and a computer. The control program causes the computer to function as a determination unit that determines a discharge state of liquid in the discharge unit, based on a first detection signal and a second detection signal, the first detection signal being output as a detection result of residual vibration occurring in the discharge unit after a potential of the drive signal supplied to the piezoelectric element changes to a first potential from a potential different from the first potential, by the detection unit and the second detection signal being output as a detection result of residual vibration occurring in the discharge unit after the potential of the drive signal supplied to the piezoelectric element changes to a second potential from a potential different from the second potential, by the detection unit.

In this case, since a discharge state is determined based on two detection signals of the first detection signal and the second detection signal, it is possible to increase the accuracy of the determination of the discharge state, as compared with the case of determining the discharge state based on one detection signal.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to the accompanying drawings. Note that the dimension and the scale of each part are appropriately different from the actual one in each drawing. Further, since the embodiments described below are preferred specific examples of the invention, technically preferable various limits are imposed, but the scope of the present invention is not limited to such aspects, unless a particular description for limiting the invention is given in the following description.

A. EMBODIMENT

In the present embodiment, a liquid discharge apparatus will be described, with an ink jet printer that discharges ink (an example of "liquid") and forms an image on a recording sheet P (an example of "medium") as an example.

1. Overview of Printing System

The configuration of an ink jet printer 1 according to the present embodiment will be described with reference to FIGS. 1 and 2.

Figure 1:
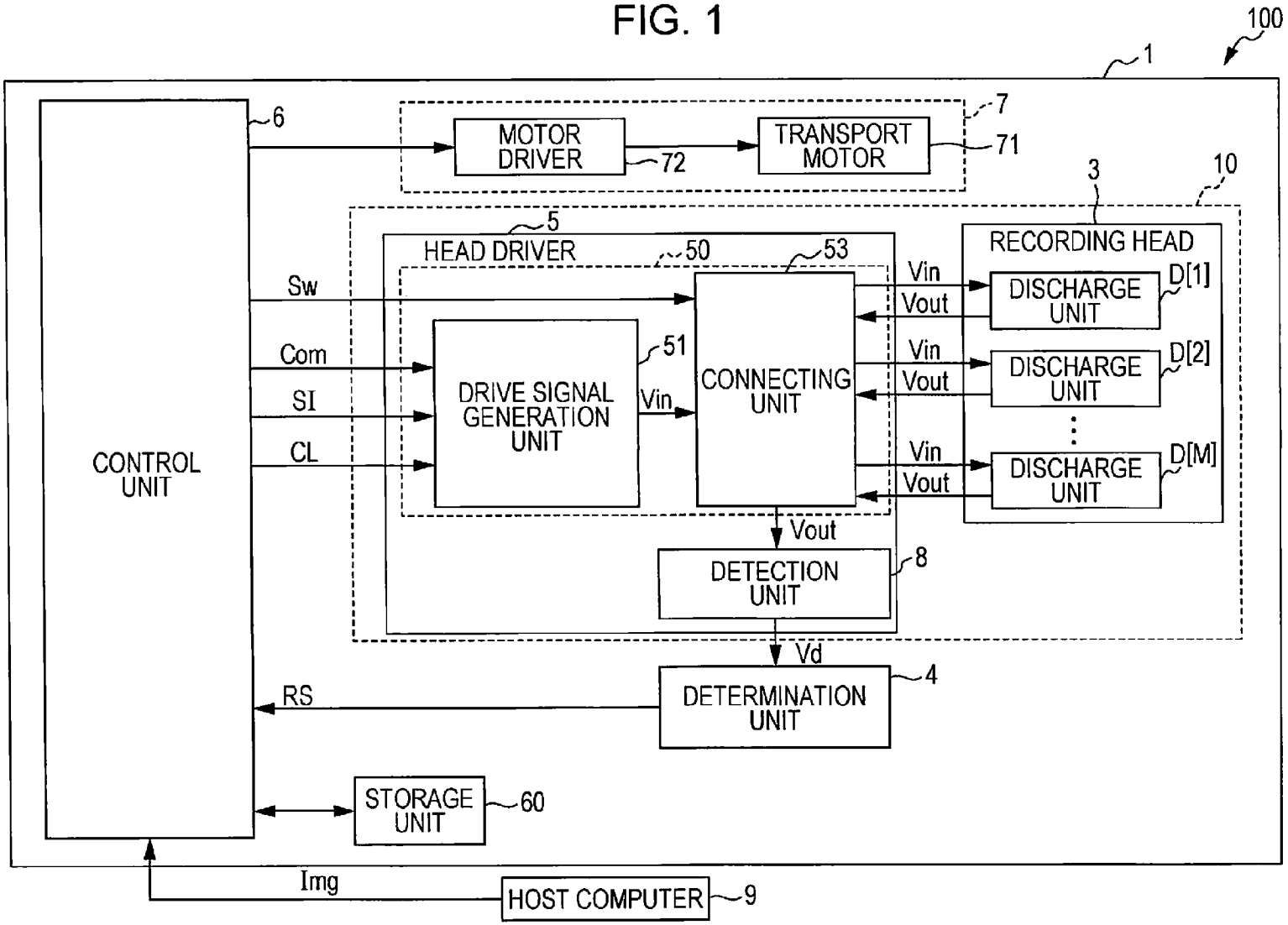
FIG. 1 is a block diagram illustrating a configuration of a printing system according to an embodiment of the present invention.

FIG. 1 is a functional block diagram illustrating a configuration of a printing system 100 equipped with the ink jet printer 1. The printing system 100 includes a host computer 9 such as a personal computer or a digital camera, and the ink jet printer 1.

The host computer 9 outputs print data Img indicating an image to be formed by the ink jet printer 1, and information indicating the number of copies of an image to be formed by the ink jet printer 1.

The ink jet printer 1 performs a printing process of forming an image represented by the print data Img supplied from the host computer 9 on the recording sheets P of only the required number of copies. Further, in the present embodiment, a case where the ink jet printer 1 is a line printer will be described as an example.

As illustrated in FIG. 1, the ink jet printer 1 includes a head unit 10 is provided with a discharge unit D that discharges ink, a determination unit 4 (an example of the "determination unit") that determines the discharge state of ink from the discharge unit D, a transport mechanism 7 for changing the relative position of the recording sheet P relative to the head unit 10, a control unit 6 that controls the operation of each part of the ink jet printer 1, a storage unit 60 that stores the control program and other types of information of the ink jet printer 1, maintenance mechanism (not illustrated) that performs a maintenance process of successfully recovering the discharge state of the ink by the discharge unit D when detecting the occurrence of abnormal discharging in the discharge unit D, a display unit that is constituted by a liquid crystal display, an LED lamp or the like, and displays an error message or the like, and a display operation unit (not illustrated) equipped with an operation unit by which the user of the ink jet printer 1 inputs various commands and the like to the ink jet printer 1.

Although the details will be described later, in the present embodiment, it is assumed that the ink jet printer 1 includes a plurality of head units 10, and a plurality of determination units 4.

Figure 2:
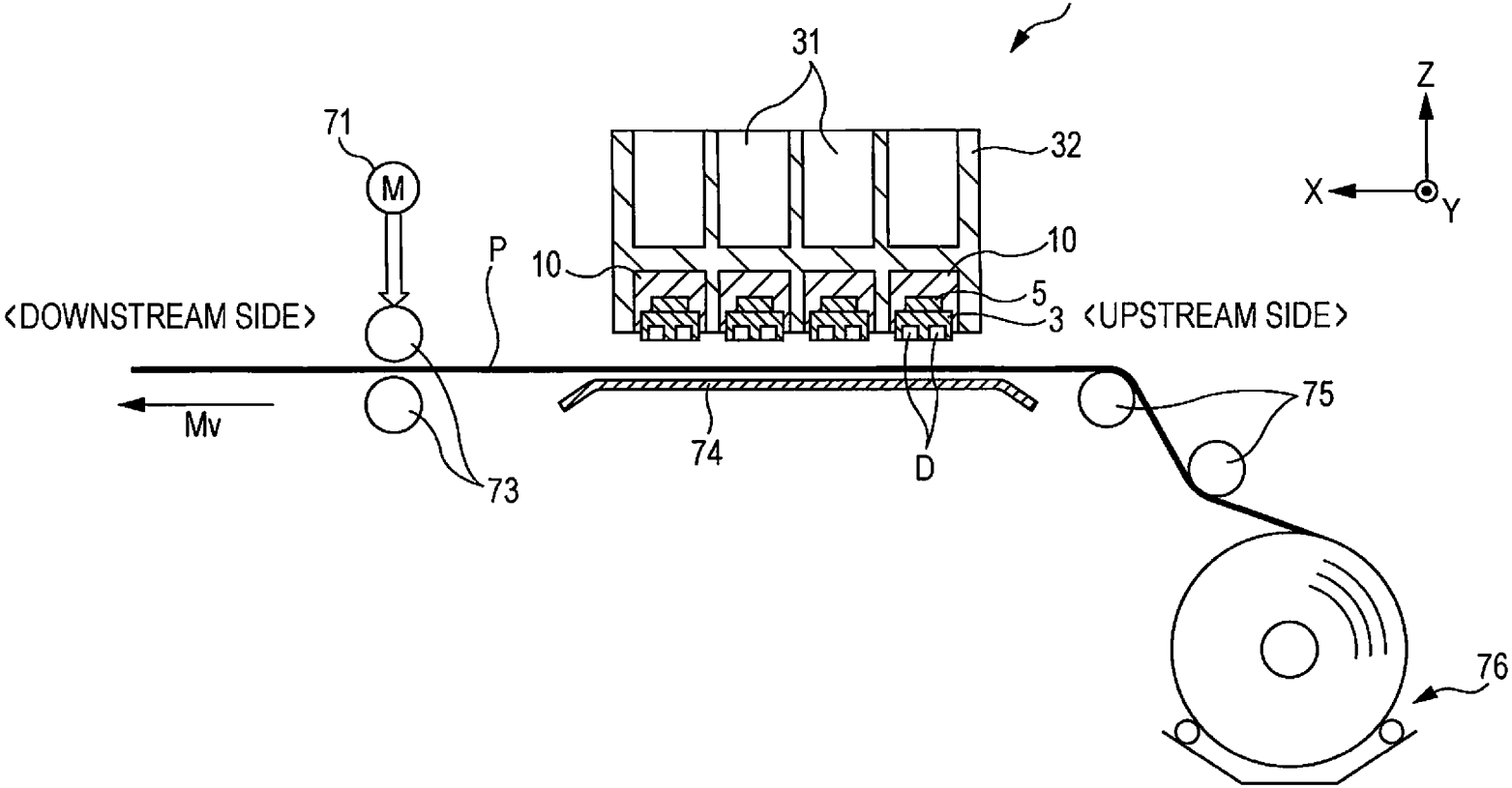
FIG. 2 is a schematic partial cross-sectional diagram of an ink jet printer.

FIG. 2 is a partial cross-sectional view illustrating an outline of the internal configuration of the ink jet printer 1.

As illustrated in FIG. 2, the ink jet printer 1 includes a mounting mechanism 32 that mounts head units 10. In addition to the head units 10, four ink cartridges 31 are mounted on the mounting mechanism 32. The four ink cartridges 31 are provided in one-to-one correspondence with four colors (CMYK) of black, cyan, magenta, and, yellow, and ink of the color corresponding to the ink cartridge 31 is filling each ink cartridge 31. Further, each ink cartridge 31 may be provided elsewhere in the ink jet printer 1, instead of being mounted on the mounting mechanism 32.

In the present embodiment, as illustrated in FIG. 2, four head units 10 are provided in the ink jet printer 1 so as to correspond to four ink cartridges 31 one-to-one. Further, in the present embodiment, four determination units 4 are provided in the ink jet printer 1 so as to correspond to four ink cartridges 31 one-to-one.

In the following description, in a description of the head unit 10 and the determination unit 4, the description will focus on a single head unit 10 and a single determination unit 4, which are provided corresponding to any one ink cartridge 31 among the four ink cartridges 31, but it is assumed that the description is applicable as well to the other three head units 10 and three determination units 4.

As illustrated in FIG. 1, the transport mechanism 7 includes a transport motor 71 which is a drive source for transporting the recording sheet P, and a motor driver 72 for driving the transport motor 71. In addition, as illustrated in FIG. 2, the transport mechanism 7 includes a platen 74 that is provided on the lower side (−Z direction in FIG. 2) of the mounting mechanism 32, a transport roller 73 that is rotated by the operation of the transport motor 71, a guide roller 75 that is provided rotatably around the Y-axis in FIG. 2, and a storage unit 76 that stores the recording sheet P in a state of being wound into a roll shape. When the ink jet printer 1 performs the printing process, the transport mechanism 7 transports the recording sheet P that is feed from the storage unit 76, along a transport path which is defined by the guide roller 75, the platen 74, and the transport roller 73, in the +X direction (a direction from the upstream side to the downstream side), at a transport speed Mv.

The storage unit 60 includes an electrically erasable programmable read-only memory (EEPROM) which is a type of a non-volatile semiconductor memory that stores print data Img supplied from the host computer 9, a random access memory (RAM) that temporarily stores data necessary for executing various processes such as the printing process, or temporarily develops a control program for executing various processes such as the printing process, and a PROM which is a type of a non-volatile semiconductor memory that stores a control program for controlling each unit of the ink jet printer 1.

The control unit 6 is configured to include a central processing unit (CPU), a field-programmable gate array (FPGA), or the like, and controls the operation of each unit of the ink jet printer 1, by the CPU or the like operating in accordance with a control program stored in the storage unit 60.

Then, the control unit 6 controls the execution of the printing process for forming an image corresponding to the print data Img on the recording sheet P, by controlling the head unit 10 and the transport mechanism 7, based on the print data Img or the like which is supplied from the host computer 9.

Specifically, the control unit 6 first stores the print data Img supplied from the host computer 9 in the storage unit 60.

Then, the control unit 6 generates a signal such as a print signal SI and a drive waveform signal Com for driving the discharge unit D, by controlling the operation of the head unit 10, based on the various types of data stored in the storage unit 60, such as the print data Img.

In addition, the control unit 6 generates signals for controlling the operation of the motor driver 72, based on the print signal SI and various pieces of data stored in the storage unit 60, and these generated various signals. The details will be described later, but the drive waveform signal Com according to the present embodiment includes drive waveform signals Com-A and Com-B.

In addition, the drive waveform signal Com is an analog of the signal. Therefore, the control unit 6 includes a DA conversion circuit, not illustrated, and converts the digital drive waveform signal generated in the CPU or the like included in the control unit 6 into an analog drive waveform signal Com, and outputs the analog drive waveform signal Com.

Thus, the control unit 6 drives the transport motor 71 so as to transport the recording sheet P in the +X direction, by controlling the motor driver 72, and controls the presence or absence of discharging of the ink from the discharge unit D, an ink discharge amount, and an ink discharge timing, by controlling the head unit 10. Thus, the control unit 6 adjusts the dot size and dot arrangement formed by the ink discharged onto the recording sheet P, and controls the execution of the printing process for forming an image corresponding to the print data Img on the recording sheet P.

In addition, details will be described later, the control unit 6 controls the execution of the discharge state determination process for determining whether or not the discharge state of ink from each discharge unit D is normal, that is, a discharge failure does not occur in each discharge unit D.

Here, the discharge failure is the generic term for a state where the discharge state of ink of the discharge unit D is abnormal, in other words, a state where the nozzle N provided in the discharge unit D is not able to accurately discharge ink (see FIGS. 3 and 4 to be described later). More specifically, the discharge failure includes a state where the discharge unit D is not able to discharge ink, a state where even in a case of being able to discharge ink from the discharge unit D, the discharged ink amount is small, and thus the discharge unit D is not able to discharge an amount of ink required for forming an image represented by the print data Img, a state where ink of an amount more than the amount required for forming an image represented by the print data Img, a state where ink discharged from the discharge unit D lands in a position different from the scheduled landing position in order to form an image represented by the print data Img, and the like.

When a discharge failure occurs in the discharge unit D, the discharge state of ink of the discharge unit D is recovered to normal, by a maintenance treatment by maintenance mechanism. Here, the maintenance treatment is a treatment of recovering the discharge state of ink of the discharge unit D to normal, by discharging ink in the discharge unit D, and newly supplying ink from the ink cartridge 31 to the discharge unit D, through a flushing process of preliminarily discharging ink from the discharge unit D, a pumping process of sucking the thickened ink, bubble, and the like in the discharge unit D by using a tube pump (not illustrate), and the like.

As illustrated in FIG. 1, each head unit 10 includes a recording head 3 provided M discharge units D, and a head driver 5 that drives each discharge unit D provided in the recording head 3 (in the present embodiment, M is a natural number satisfying $1 \leq M$). In addition, in the following description, the M discharge units D are referred to as a first stage, a second stage, . . . , a M-th stage in order, for distinguishing the M discharge units D from each other. Further, in the following description, a m-th discharge unit D may be expressed as a discharge unit D[m] (variable m is a natural number satisfying $1 \leq m \leq M$).

Each of the M discharge units D receives ink supplied from the ink cartridge 31 corresponding to the head unit 10 in which the M discharge units p are provided. Each discharge unit D fills the interior with ink supplied from the ink cartridge 31, and is able to discharge the filled ink from the nozzle N included in the discharge unit D. Specifically, each discharge unit D forms dots for making an image on the recording sheet P, by discharging ink onto the recording sheet P, at timing when the transport mechanism 7 transports the recording sheet P onto the platen 74. Then, full-color printing is implemented by discharging ink of four colors of CMYK as a whole from a total of (4*M) discharge units D which are provided in four head units 10.

As illustrated in FIG. 1, the head driver 5 includes a drive signal supply unit 50 (an example of "supply unit") that supplies a drive signal Vin for driving each of M discharge units D included in the recording head 3 to each discharge unit D, and a detection unit 8 (an example of "detection unit") that detects residual vibration occurring in the discharge unit D after the discharge unit D is driven in response to the drive signal Vin.

Further, in the following description, a discharge unit D that is a target of detection of residual vibration by the detection unit 8, among M discharge units D may be referred to as a target discharge unit Dtg. Although the details will be described later, the target discharge unit Dtg is designated from among the M discharge units D, by the control unit 6.

The drive signal supply unit 50 is provided with a drive signal generation unit 51, and a connecting unit 53.

The drive signal generation unit 51 generates the drive signal Vin for driving respective M discharge units D provided in the recording head 3, based on signals supplied from the control unit 6, such as the print signal SI, the clock signal CL, and the drive waveform signal Com.

The connecting unit 53 electrically connects each discharge unit D to either the drive signal generation unit 51 or the detection unit 8, based on a connection control signal Sw supplied from the control unit 6. The drive signal Vin generated in the drive signal generation unit 51 is supplied to the discharge unit D through the connecting unit 53. If the drive signal Vin is supplied, each discharge unit D is driven based on the supplied drive signal Vin, so as to be able to discharge ink that is filling the inside, onto the recording sheet P.

The detection unit 8 detects a residual vibration signal Vout indicating residual vibration occurring in the discharge unit D after the discharge unit D that is designated as a target discharge unit Dtg is driven in response to the drive signal Vin. Then, the detection unit 8 generates a waveform shaping signal Vd by performing a process such as removing a noise component or amplifying a signal level, on the detected residual vibration signal Vout, and outputs the generated waveform shaping signal Vd. Further, in the present embodiment, the drive signal supply unit 50 and the detection unit 8 are mounted, for example, as an electronic circuit on a substrate provided in the head unit 10.

The determination unit 4 determines the discharge state of ink by the discharge unit D that is designated as a target discharge unit Dtg, based on a waveform shaping signal Vd that is output by the detection unit 8, at the time of executing the discharge state determination process, and generates determination information RS indicating the determination result. Further, in the present embodiment, the determination unit 4 is mounted, for example, as an electronic circuit on a substrate provided in a location different from the head unit 10.

In addition, the discharge state determination process is a series of processes to be executed by the ink jet printer 1, in which, under the control of the control unit 6, the drive signal supply unit 50 drives a discharge unit D that is designated as a target discharge unit Dtg, the detection unit 8 detects the residual vibration occurring in the discharge unit D, and the determination unit 4 generates determination information RS, based on a waveform shaping signal Vd that is output by the detection unit 8 which has detected the residual vibration, and standard information STth that is output by the control unit 6.

In addition, in the following description, the reference symbol representing the component or the information corresponding to the number m of stages may be expressed by attaching the subscript [m] representing the number m of stages, in such a way of representing determination information RS indicating the discharge state of ink of the discharge unit D[m] as determination information RS[m], and the drive signal Vin supplied to the discharge unit D[m] as a drive signal Vin[m].

2. Configuration of Recording Head

The recording head 3 and the discharge unit D provided in the recording head 3 will be described with reference to FIGS. 3 and 4.

Figure 3:
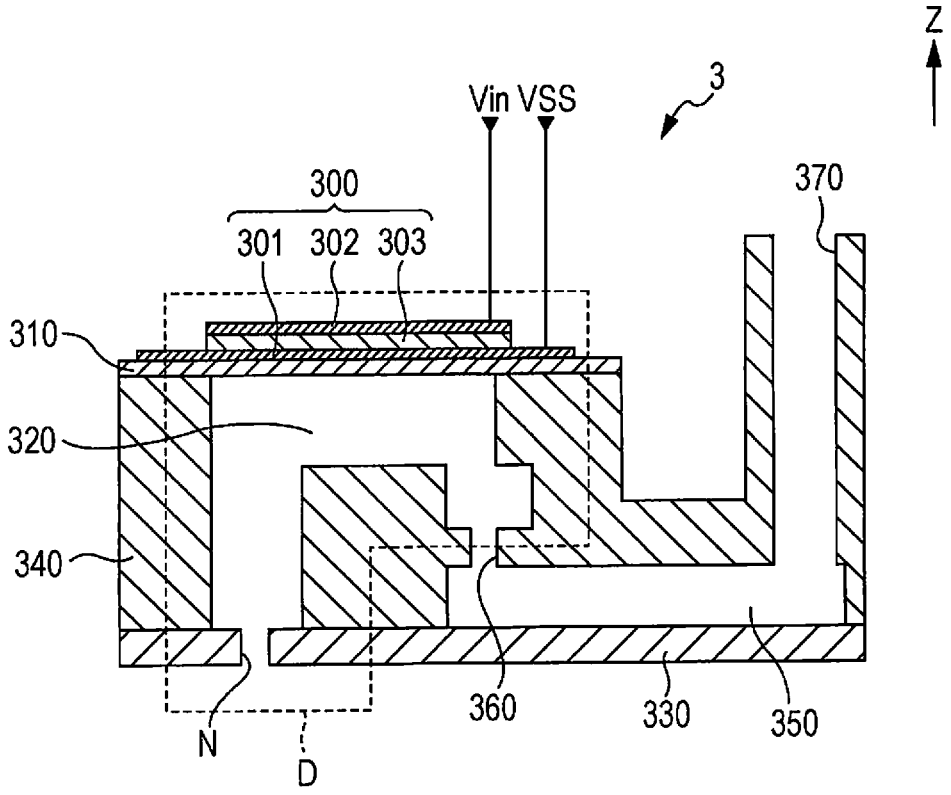
FIG. 3 is a schematic cross-sectional diagram of a recording head.

FIG. 3 is an example of a schematic partial cross-sectional diagram of the recording head 3. For convenience of illustration, FIG. 3 illustrates one discharge unit among M discharge units D included in the recording head 3, and a reservoir 350 in communication with the one single discharge unit D through the ink supply port 360, an ink intake port 370 for supplying ink from the ink cartridge 31 to the reservoir 350.

As illustrated in FIG. 3, the discharge unit D includes a piezoelectric element 300, a cavity 320 (an example of "pressure chamber") inside of which ink is filled, a nozzle N in communication with the cavity 320, and a vibrating plate 310. The discharge unit D discharge ink filling the cavity 320 from the nozzle N, by the piezoelectric element 300 being driven in response to the drive signal Vin. The cavity 320 of the discharge unit D is a space defined by a cavity plate 340 that is molded into a predetermined shape so as to have a recess, a nozzle plate 330 including the nozzle N formed thereon, and the vibrating plate 310. The cavity 320 is in communication with the reservoir 350 through the ink supply port 360. The reservoir 350 is in communication with one ink cartridge 31 through the ink intake port 370.

In the present embodiment, for example, a unimorph (monomorph) type as illustrated in FIG. 3 is employed as the piezoelectric element 300. In addition, the piezoelectric element 300 is not limited to the unimorph type, and a bimorph type, a stacked type, or the like may be employed.

The piezoelectric element 300 includes a lower electrode 301, an upper electrode 302, and a piezoelectric body 303 which is provided between the lower electrode 301 and the upper electrode 302. Since the potential of the lower electrode 301 is set to a predetermined reference potential VSS, and the upper electrode 302 is supplied with the drive signal Vin, if a voltage is applied to between the lower electrode 301 and the upper electrode 302, the piezoelectric element 300 is deflected (displaced) in a vertical direction in FIG. 3 in response to the applied voltage, and as a result, the piezoelectric element 300 vibrates.

The vibrating plate 310 provided on the upper opening portion of the cavity plate 340, and the vibrating plate 310 is connected to the lower electrode 301. Therefore, if the piezoelectric element 300 vibrates by the drive signal Vin, the vibrating plate 310 also vibrates. The volume of the cavity 320 (the pressure in the cavity 320) varies due to the vibration of the vibrating plate 310, and the ink filling the cavity 320 is discharged from the nozzle N. If the ink in the cavity 320 is reduced by the discharge of ink, ink is supplied from the reservoir 350. Further, ink is supplied from the ink cartridge 31 to the reservoir 350 through the ink intake port 370.

Figure 4:
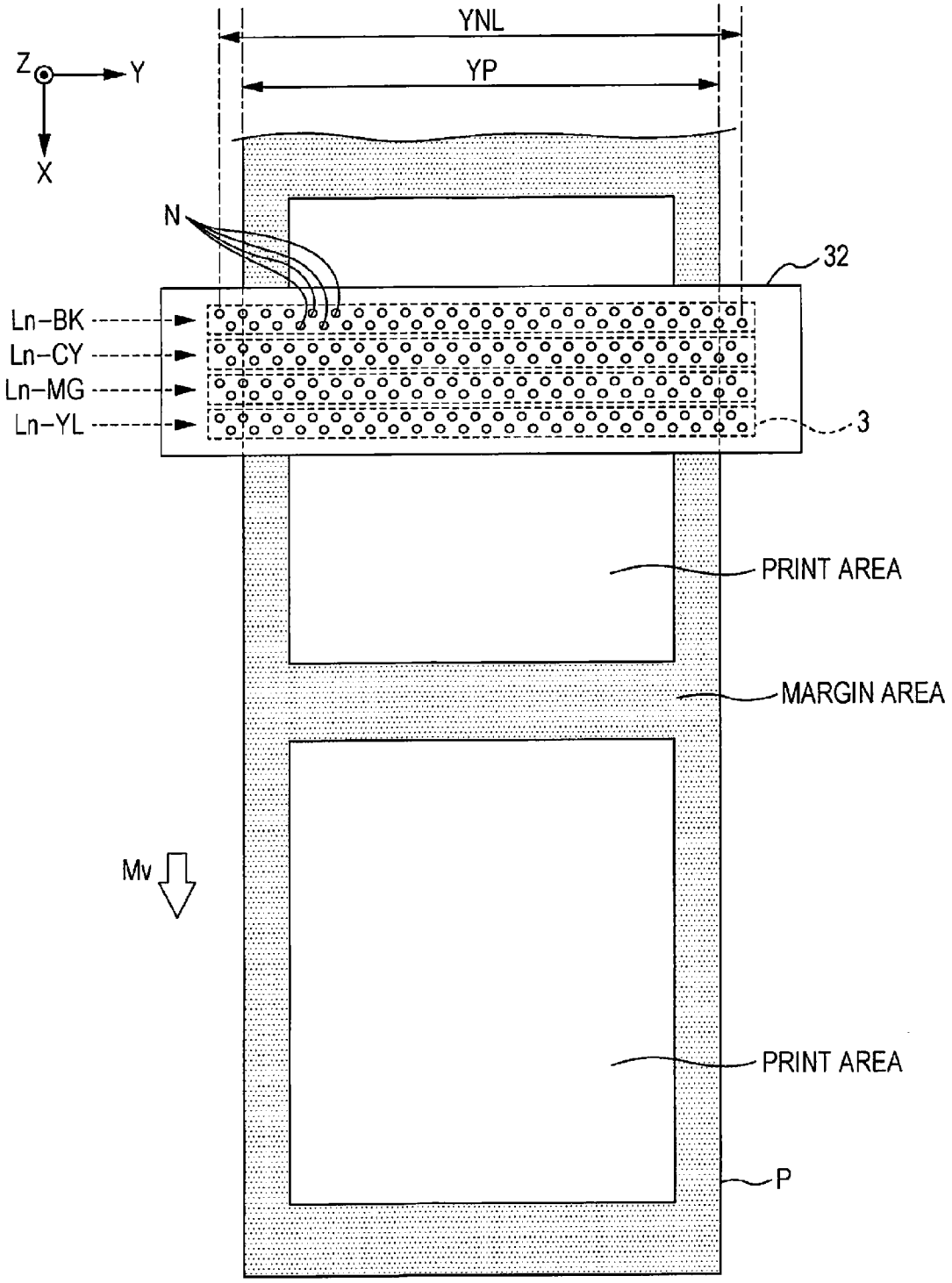
FIG. 4 is a plan view illustrating an arrangement example of a nozzle in the recording head.

FIG. 4 is an explanatory diagram illustrating an example of an arrangement of M nozzles N that are provided in each of four recording heads 3, which is mounted on the mounting mechanism 32, when viewing the ink jet printer 1 from +Z direction or −Z direction in plan view.

As illustrated in FIG. 4, a nozzle array Ln constituted by M nozzles N is provided in each recording head 3. In other words, the ink jet printer 1 includes four nozzle arrays Ln. Specifically, the ink jet printer 1 includes four nozzle arrays Ln constituted by a nozzle array Ln-BK, a nozzle array Ln-CY, a nozzle array Ln-MG, and a nozzle array Ln-YL. Here, each of a plurality of nozzles N belonging to the nozzle array Ln-BK is a nozzle N that is provided in the discharge unit D that discharges black ink, each of a plurality of nozzles N belonging to the nozzle array Ln-CY is a nozzle N that is provided in the discharge unit D that discharges cyan ink, each of a plurality of nozzles N belonging to the nozzle array Ln-MG is a nozzle N that is provided in the discharge unit D that discharges magenta ink, and each of a plurality of nozzles N belonging to the nozzle array Ln-YL is a nozzle N that is provided in the discharge unit D that discharges yellow ink. Further, in the present embodiment, each of four nozzle arrays Ln is provided so as to extend in +Y direction or −Y direction (hereinafter, +Y direction and −Y direction are collectively referred to as "Y-axis direction") in plan view. When printing the recording sheet P (to be exact, a recording sheet P of which the width in the Y-axis direction is a maximum printable width of the ink jet printer 1, among recording sheets P), a range YNL, in which each nozzle array Ln extends in the Y-axis direction, is equal to or more than the a range YP in the Y-axis direction possessed by the recording sheet P.

As illustrated in FIG. 4, a plurality of nozzles N constituting each nozzle array Ln are arranged in a so-called staggered pattern such that the positions in the X-axis direction of the even-numbered nozzle N and the odd-numbered nozzle N from the left side (−Y side) are different from each other in FIG. 4. In each nozzle array Ln, an interval (pitch) between nozzles N in the Y-axis direction can appropriately be set according to a print resolution (dpi: dot per inch).

In addition, the printing process in the present embodiment, as an example, as illustrated in FIG. 4, a case is assumed in which the recording sheet P is divided into a plurality of print areas (for example, a rectangular area of an A4-size in a case of printing a A4-size image on the recording sheet P, or a label of a label sheet), and a margin areas for partitioning the respective plurality of print areas, and a plurality of images corresponding to a plurality of print areas are formed in one-to-one.

3. Operation and Residual Vibration of Discharge Unit

Next, an ink discharging operation by the discharge unit D and residual vibration occurring in the discharge unit D will be described with reference to FIGS. 5A to 13.

Figure 5A:
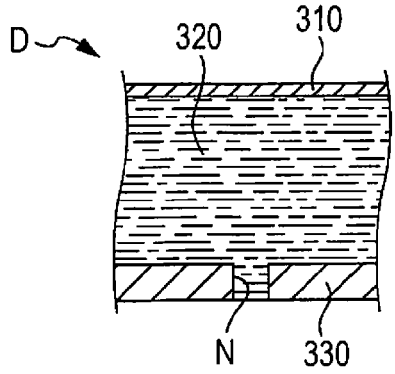
FIGS. 5A to 5C are diagrams illustrating a change in a cross-sectional shape of a discharge unit when a drive signal is supplied.
Figure 5B:
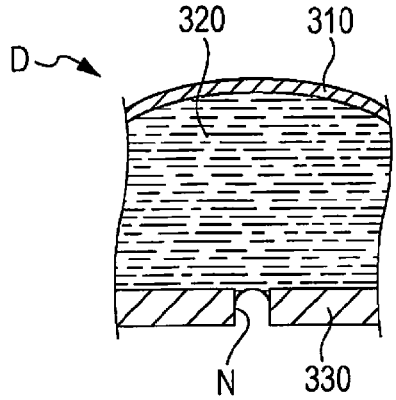
Figure 5C:
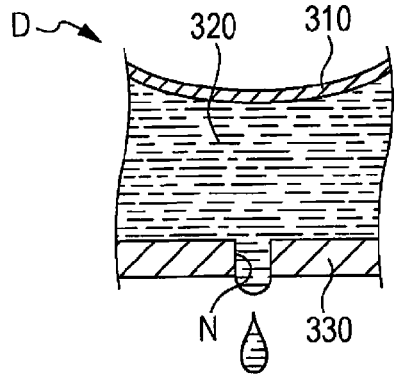

FIGS. 5A to 5C is an explanatory diagram illustrating an ink discharging operation by the discharge unit D. In the state illustrated in FIG. 5A, if the drive signal Vin is supplied from the head driver 5 to the piezoelectric element 300 provided in the discharge unit D, distortion caused by an electric field applied to between electrodes occurs in the piezoelectric element 300, and the vibrating plate 310 of the discharge unit D bends in the upper direction. Thus, as compared with the initial state illustrated in FIG. 5A, the volume of the discharge unit D of the cavity 320 to expand, as illustrated in FIG. 5B. In the state illustrated in FIG. 5B, if the potential represented by the drive signal Vin varies, the vibrating plate 310 is restored by its elastic restoring force, is displaced in the lower direction beyond the position of the vibrating plate 310 in the initial state, and the volume of the cavity 320 is rapidly contracted as illustrated in FIG. 5C. In this case, a portion of the ink filled the cavity 320 is discharged as ink droplets from the nozzle N in communication with the cavity 320, by the compressed pressure generated in the cavity 320.

As in the case illustrated in FIGS. 5A to 5C, after the vibrating plate 310 of the discharge unit D is driven in response to the drive signal Vin and is displaced in the upper direction or in the lower direction, the vibrating plate 310 is vibrated. The vibration remains after the discharge unit D is driven in response to the drive signal Vin. It is assumed that such residual vibration that remains after the discharge unit D is driven in response to the drive signal Vin has an inherent vibration frequency determined by an acoustic resistance Res caused by the shape of the nozzle N or the ink supply port 360, the viscosity of ink, or the like, an inertance Int caused by ink weight in the flow path, and a compliance Cm of the vibrating plate 310. Hereinafter, a calculation model of the residual vibration occurring in the vibrating plate 310 of the discharge unit D will be described based on the assumption.

Figure 6:
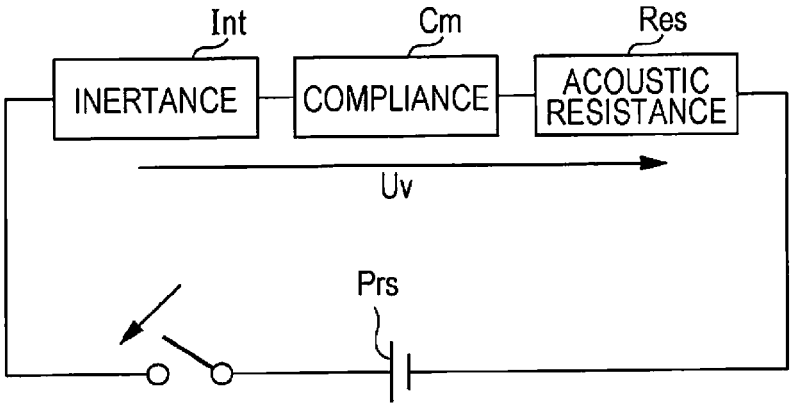
FIG. 6 is a circuit diagram illustrating a model of single vibration representing residual vibration of the discharge unit.

FIG. 6 is a circuit diagram illustrating a calculation model of single vibration assuming the residual vibration of the vibrating plate 310. In this way, the calculation model of the residual vibration of the vibrating plate 310 is expressed by a sound pressure Prs, and the inertance Int, the compliance Cm, and the acoustic resistance Res which are described above. Then, if a step response at the time giving the sound pressure Prs to the circuit of FIG. 6 calculated for the volume velocity Uv, the following equation is obtained.

$$Uv=\{Prs/(\omega\cdot Int)\}e^{-\gamma t}\cdot\sin(\omega t)$$

$$\omega=\{1/(Int\cdot Cm)-\gamma^2\}^{1/2}$$

$$\gamma=Res/(2\cdot Int)$$

The calculation results (calculated values) that is obtained from the equation, and the experimental results (experimental values) of experiments of the residual vibration of the discharge unit D that are performed separately are compared. Note that the experiment of residual vibration is an experiment for detecting the residual vibration occurring in the vibrating plate 310 of the discharge unit D, after discharging ink from the discharge unit D of which the ink discharge state is normal.

Figure 7:
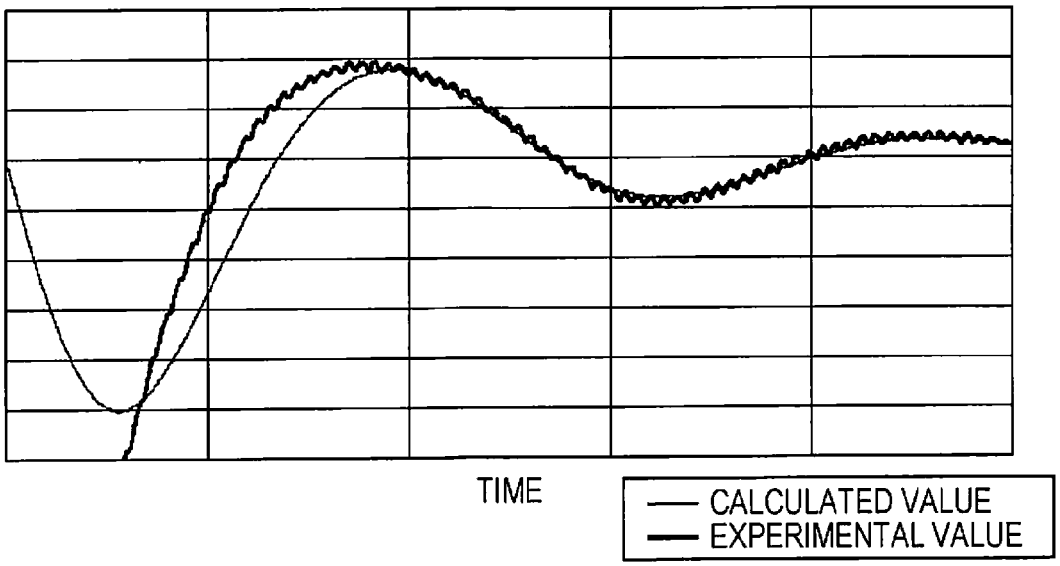
FIG. 7 is a graph representing a relationship between an experimental value and a calculated value of residual vibration of a discharge unit.

FIG. 7 is a graph representing a relationship between an experimental value and a calculated value of the residual vibration. As can be seen from the graph illustrated in FIG. 7, when the discharged state of ink by the discharge unit D is normal, two waveforms of the experimental value and the calculated values are generally consistent.

Incidentally, even though the discharge unit D performs an ink discharging operation, there is a case where the discharge state of ink of the discharge unit D is abnormal, and the ink droplets do not properly discharge from the nozzle N of the discharge unit D, that is, a discharge failure occurs. Examples of the cause of the occurrence of this discharge failure include (1) mixing of bubble into the cavity 320, (2) thickening or adherence of ink in the cavity 320 due to drying of the ink in the cavity 320, (3) attachment of foreign matter such as paper dust to the vicinity of the outlet of the nozzle N, and the like.

As described above, the discharge failure is typically a state that ink is not able to be discharged from the nozzle N, that is, a non-discharge phenomenon of ink appears, and in this case, the missing dots occurs in pixels of the image printed on the recording sheet P. In addition, as described above, in the case of a discharge failure, even if ink is discharged from the nozzle N, the ink does no properly land due to a significantly small amount of ink or the shift of the heading direction (trajectory) of discharged ink droplets, such that the missing dots still occurs in pixels.

In the following description, at least one of the acoustic resistance Res and the inertance Int is adjusted based on the comparison results illustrated in FIG. 7, such that the calculated value and the experimental value of the residual vibration is almost coincide, for each cause of the discharge failure occurring in the discharge unit D.

Figure 8:
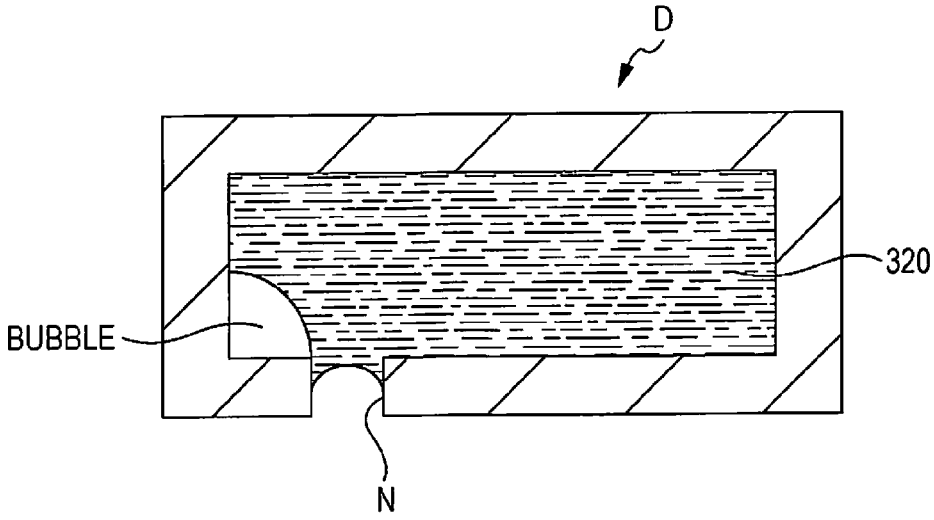
FIG. 8 is an explanatory diagram illustrating the state of the discharge unit when bubble is mixed into the discharge unit.

First, (1) mixing of bubble into the cavity 320, which is one of the causes of the discharge failure, will be considered. FIG. 8 is a conceptual diagram illustrating a case where bubble is mixed into the cavity 320. As illustrated in FIG. 8, when bubble is mixed into the cavity 320, it is considered that the total weight of ink filling the cavity 320 is reduced and the inertance Int is reduced. Further, when bubble is adhered to the vicinity of the nozzle N, the nozzle N is considered to become larger in its diameter by the size of the diameter of the bubble, and the acoustic resistance Res is considered to decrease.

Figure 9:
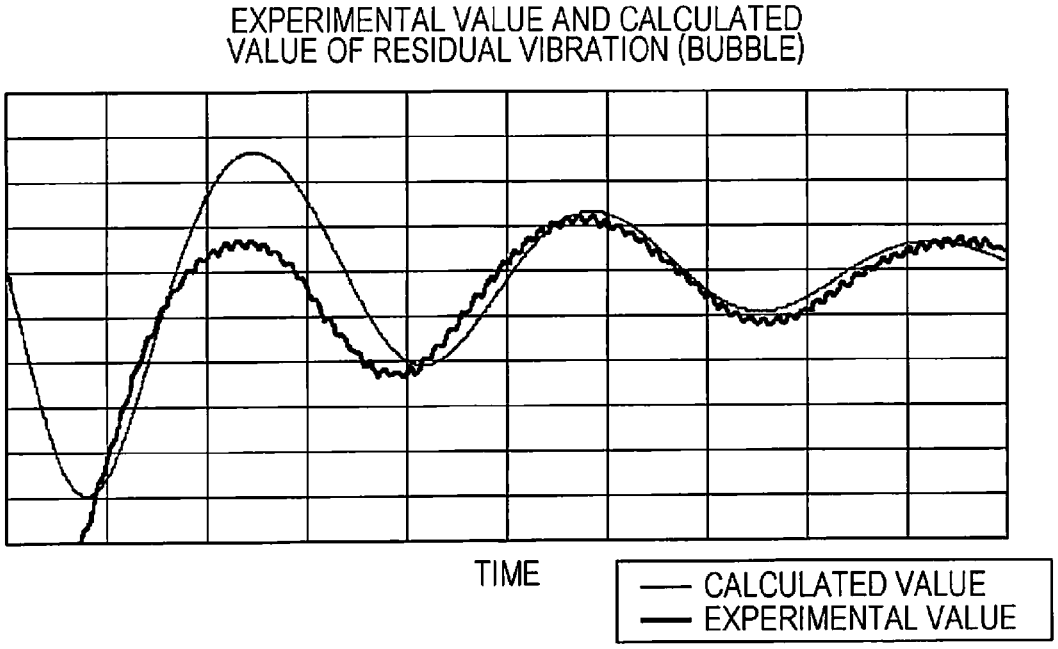
FIG. 9 is a graph representing an experimental value and a calculated value of residual vibration of the discharge unit.

Thus, as compared with the case where the discharge state of ink is normal as illustrated in FIG. 7, the acoustic resistance Res and the inertance Int are set to be smaller, and match the experimental value of the residual vibration at the time of bubble mixing, and thus the graph as FIG. 9 is obtained. As illustrated in FIGS. 7 and 9, when the bubble is mixed into the cavity 320 and a discharge failure occurs, the frequency of the residual vibration is higher, as compared with the case where the discharge state is normal. In addition, the attenuation rate of the amplitude of the residual vibration decreases due to a decrease in the acoustic resistance Res, and it is confirmed that the residual vibration is slowly lowered in its amplitude.

Figure 10:
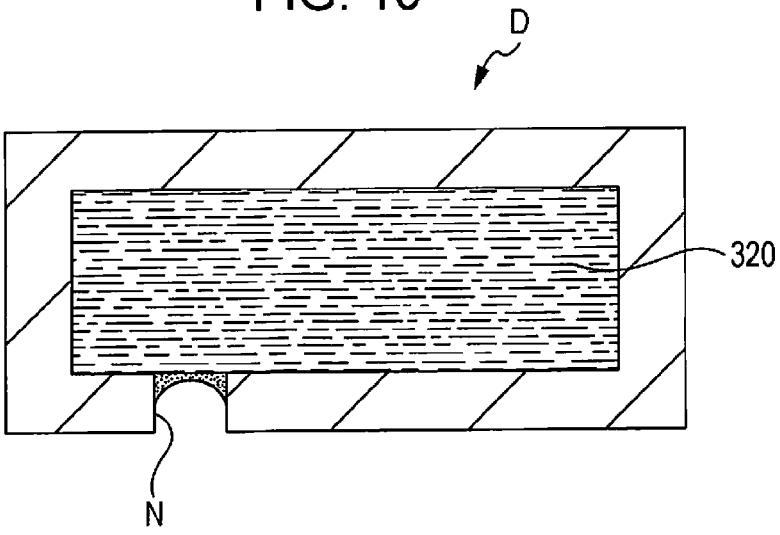
FIG. 10 is an explanatory diagram illustrating the state of the discharge unit when ink in the vicinity of a nozzle is adhered.

Next, (2) thickening or adherence of ink in the cavity 320, which is one of the causes of the discharge failure, will be considered. FIG. 10 is a conceptual diagram illustrating a case where ink in the vicinity of the nozzle N of the cavity 320 is adhered due to drying thereof. As illustrated in FIG. 10, when the ink in the vicinity of the nozzle N is adhered, it becomes a situation in which the ink in the cavity 320 is confined within the cavity 320. In this case, the acoustic resistance Res is considered to increase.

Figure 11:
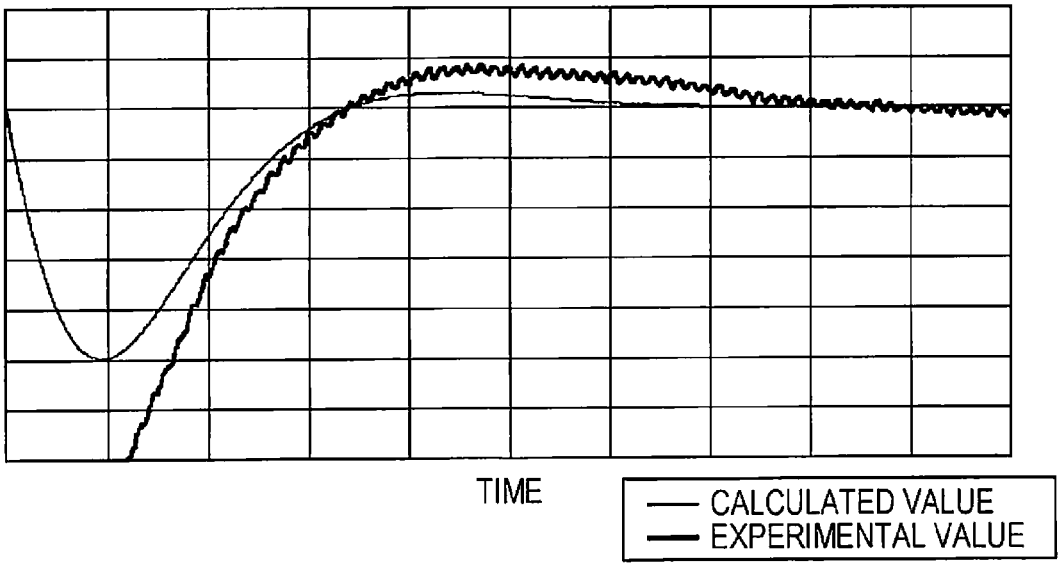
FIG. 11 is a graph representing an experimental value and a calculated value of residual vibration of the discharge unit.

Thus, as compared with the case where the discharge state of ink is normal as illustrated in FIG. 7, the acoustic resistance Res is set to be larger, and match the experimental value of the residual vibration when ink in the vicinity of the nozzle N is adhered or thickened, and thus the graph illustrated as FIG. 11 is obtained. Incidentally, the experimental value illustrated in FIG. 11 is obtained by measuring the residual vibration of the vibrating plate 310 provided in the discharge unit D in a state where ink in the vicinity of the nozzle N is adhered, by leaving the discharge unit D in a state of not wearing a cap, not illustrated, for a few days. As illustrated in FIGS. 7 and 11, when the ink in the vicinity of the nozzle N in the cavity 320 is adhered, the frequency of the residual vibration is extremely lower, as compared with the case where the discharge state is normal, and the characteristic waveform in which the residual vibration is excessively attenuated is obtained. The reason is as follows. Since the vibrating plate 310 is drawn in the +Z direction (upwardly) in order to discharge ink, when the vibrating plate 310 is moved in the −Z direction (downwardly) after the ink is flowed into the cavity 320 from the reservoir, the ink in the cavity 320 does not flow out, the vibrating plate 310 cannot rapidly vibrate (excessively attenuated).

Figure 12:
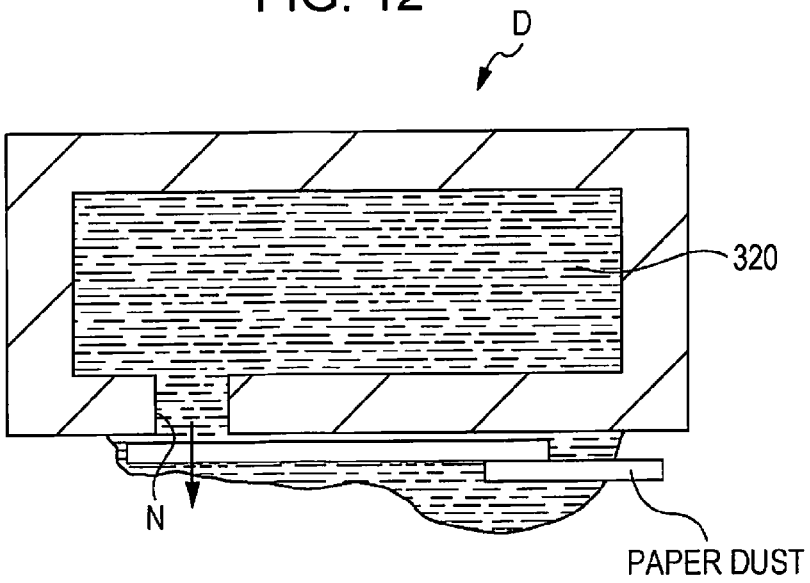
FIG. 12 is an explanatory diagram illustrating the state of the discharge unit when paper dust is adhered.

Next, (3) attachment of foreign matter such as paper dust to the vicinity of the outlet of the nozzle N, which is one of the causes of the discharge failure, will be considered. FIG. 12 is a conceptual diagram illustrating a case where paper dust is attached to the vicinity of the outlet of the nozzle N. As illustrated in FIG. 12, when paper dust is attached to the vicinity of the outlet of the nozzle N, the ink is exuded through the paper dust from the inside of the cavity 320, and thus it becomes impossible to discharge ink from the nozzle N. When paper dust is attached to the vicinity of the outlet of the nozzle N, and the ink is exuded from the nozzle N, ink of the amount exuded from the inside of cavity 320 when viewed from the vibrating plate 310 increases than the case where the discharge state is normal, and thus the inertance Int is considered to increase. Further, it is considered that the acoustic resistance Res increases due to the fibers of the paper dust adhered to the vicinity of the outlet of the nozzle N.

Figure 13:
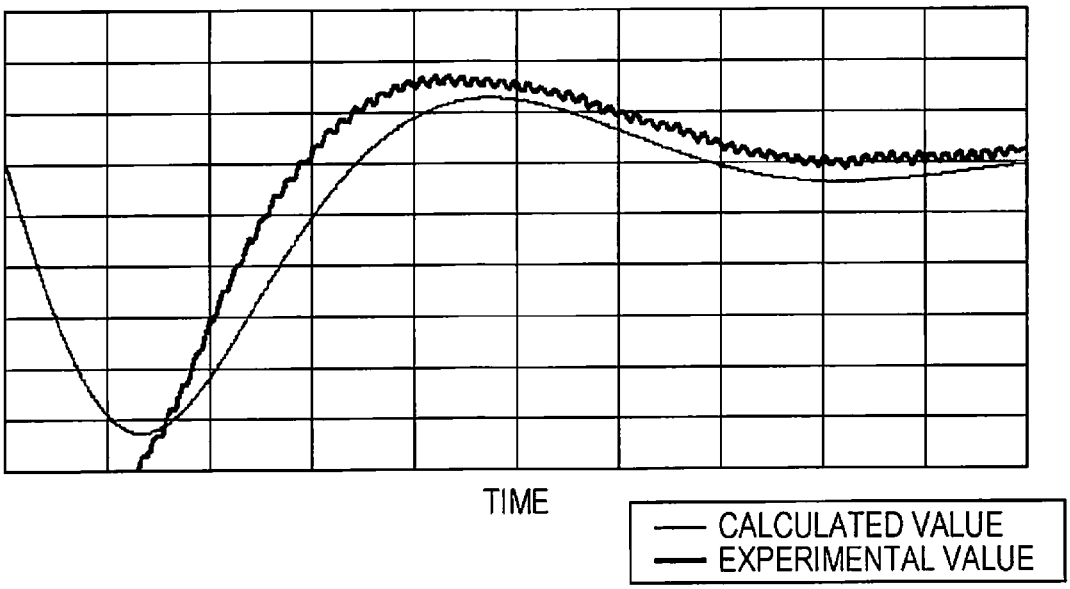
FIG. 13 is a graph representing an experimental value and a calculated value of residual vibration of the discharge unit.

Thus, as compared with the case where the discharge state of ink is normal as illustrated in FIG. 7, the inertance Int and the acoustic resistance Res are set to be larger, and match the experimental value of the residual vibration at the time of adhering of paper dust to the vicinity of the outlet of the nozzle N, and thus the graph as FIG. 13 is obtained. As can be seen from the graphs of FIGS. 7 and 13, when paper dust is adhered to the vicinity of the outlet of the nozzle N, the frequency of the residual vibration is lower, as compared with the case where the discharge state is normal.

In addition, in the case of (3) attachment of foreign matter such as paper dust to the vicinity of the outlet of the nozzle N, it can be seen from the graphs of FIGS. 11 and 13 that the frequency of the residual vibration is higher, as compared with the case of (2) thickening of ink in the cavity 320.

Here, in the case of (2) thickening of ink and the case of (3) attachment of paper dust to the vicinity of the outlet of the nozzle N, the frequency of the residual vibration is lower, as compared with the case where the discharge state of ink is normal. The causes of these two discharge failures can be distinguished by comparing the waveform of the residual vibration, specifically, the frequency or the cycle of the residual vibration with a predetermined threshold.

As apparent from the above description, it is possible determine the discharge state of the discharge unit D, based on the waveform of the residual vibration, specifically, the frequency or the cycle of the residual vibration occurring when driving the discharge unit D. More specifically, it is possible to determine whether or not the discharge state of the discharge unit D is normal, based on the frequency or the cycle of the residual vibration, and when the discharge state of the discharge unit D is abnormal, it is possible to determine which one of (1) to (3) described above the cause of the discharge failure corresponds to. The ink jet printer 1 according to the present embodiment performs a discharge state determination process for determining a discharge state by analyzing the residual vibration.

4. Configurations and the Operations of Head Driver and Determination Unit

Next, the head driver 5 (the drive signal generation unit 51, the connecting unit 53, and the detection unit 8) and the determination unit 4 will be described with reference to FIGS. 14 to 18.

4.1. Drive Signal Generation Unit

Figures 14, 15:
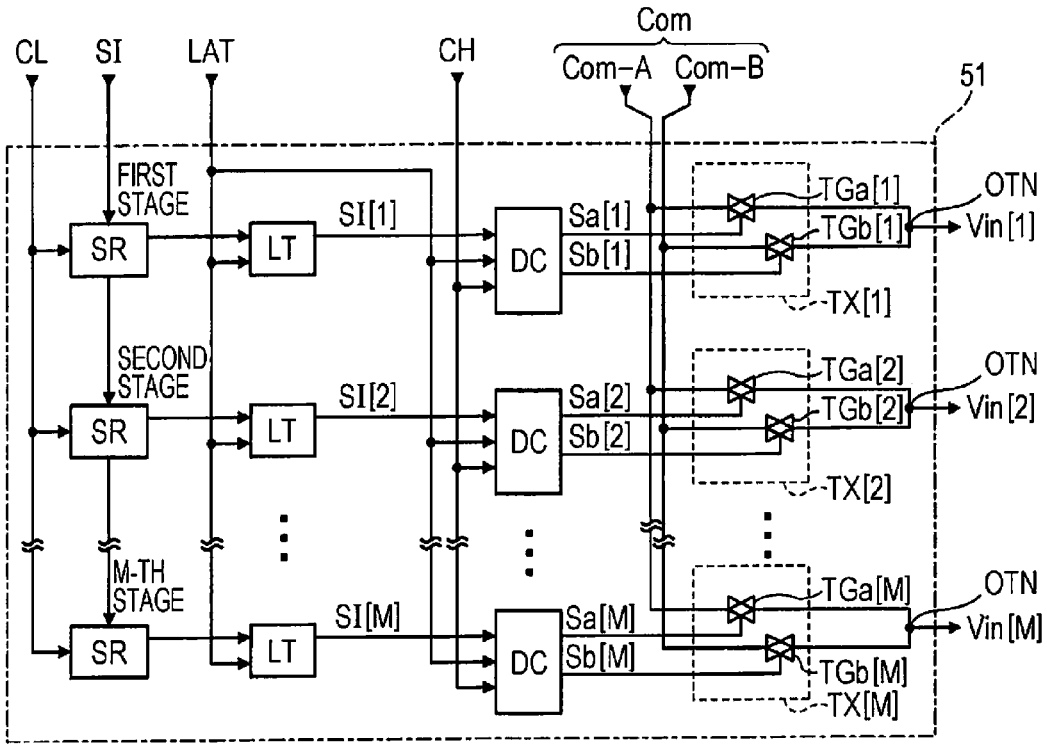
FIG. 14 is a block diagram illustrating a configuration of a drive signal generation unit.
FIG. 15 is an explanatory diagram illustrating decoding details of a decoder.

FIG. 14 is a block diagram illustrating a configuration of the drive signal generation unit 51 of the head driver 5.

As illustrated in FIG. 14, the drive signal generation unit 51 includes a set of a shift register SR, a latch circuit LT, a decoder DC, and a switching unit TX so as to correspond to the M discharge units D in one-to-one. Hereinafter, respective elements constituting the M sets may be referred to as a first stage, a second stage, . . . , and a M-th stage in order from the top in FIG. 14.

A clock signal CL, a print signal SI, a latch signal LAT, a change signal CH, and drive waveform signals Com (Com-A, Com-B) are supplied to the drive signal generation unit 51 from the control unit 6.

The drive waveform signals Com (Com-A, Com-B) are signals including a plurality of waveforms for driving the discharge unit D.

The print signal SI is a digital signal for specifying a waveform of the drive waveform signal Com supplied to each discharge unit D, and as a result, for designating the presence or absence of the discharge of ink from the discharge unit D, and the amount of ink to be discharged by each discharge unit D. The print signal SI includes print signals SI[1] to SI[M]. Among them, the print signal SI[m] designates the presence or absence of the discharge of ink from the discharge unit D[m] and the amount of ink to be discharged by a discharge unit D[m] by the upper bit b1 and the lower bits b2.

Specifically, the print signal SI[m] designates any one of discharging of ink of an amount corresponding to a large dot, discharging of ink of an amount corresponding to a medium dot, discharging of ink of an amount corresponding to a small dot, and non-discharging of ink, for the discharge unit D[m] (see FIG. 15).

The drive signal generation unit 51 supplies the drive signal Vin having the waveform designated by the print signal SI[m] to the discharge unit D[m]. Further, as described above, among the drive signals Vin, a drive signal Vin, that has a waveform designated by the print signal SI[m] and is supplied to the discharge unit D[m], is referred to as a drive signal Vin[m].

The shift register SR temporarily stores print signals SI (SI[1] to SI[M]) supplied in series, at every two bits corresponding to each discharge unit D. Specifically, the shift register SR has a configuration in which M shift registers SR of a first stage, a second stage, . . . , and a M-th stage, corresponding to M discharge units D in one-to-one, are connected in cascade to each other, and sequentially transfers the print signals SI supplied in series, to the subsequent stage in response to a clock signal CL. If the print signals SI are transferred to all of the M shift registers SR, each of the M shift registers SR maintains a state of storing data of two bits, corresponding to its own, among print signals SI. Hereinafter, the m-th stage of shift register SR may be referred to as a shift register SR[m].

Each of the M latch circuits LT simultaneously latches the print signal SI[m] of two bits corresponding to each stage, that is stored in each of the M shift registers SR, at a timing when a latch signal LAT rises. In other words, the m-th stage of latch circuit LT latches the print signal SI [m], which is stored in the shift register SR[m].

However, an operation period when the ink jet printer 1 performs a printing process or an discharge state determination process is configured with a plurality of unit periods Tu.

The control unit 6 supplies the print signal SI and the drive waveform signal Com to the drive signal generation unit 51 at each unit period Tu, and supplies a latch signal LAT causing the latch circuit LT to latch the print signal SI[m] at each unit period Tu. Thus, the control unit 6 controls the drive signal generation unit 51 so as to supply the drive signal Vin[m] for driving the discharge unit D[m] to execute any one of discharging of ink of an amount corresponding to a large dot, discharging of ink of an amount corresponding to a medium dot, discharging of ink of an amount corresponding to a small dot, and non-discharging of ink, to the discharge unit D[m], at each unit period Tu.

In addition, in the present embodiment, the control unit 6 divides the unit period Tu into a control period Ts1 and a control period Ts2, by a change signal CH. The control periods Ts1 and Ts2 have durations equal to each other. Hereinafter, the control periods Ts1 and Ts2 may be collectively referred to as a control period Ts.

The decoder DC decodes the print signal SI[m] that is latched by the latch circuit LT, and outputs selection signals Sa[m] and Sb[m].

FIG. 15 is an explanatory diagram illustrating decoding details of the m-th stage of decoder DC at each unit period Tu. As illustrated in FIG. 15, the m-th stage of decoder DC outputs selection signals Sa[m] and Sb[m] in each of the control periods Ts1 and Ts2 of each unit period Tu. For example, if the print signal SI[m] supplied in unit period Tu is (b1, b2)=(1, 0), the m-th stage of decoder DC sets the selection signal Sa[m] to a high level H, and the selection signal Sb[m] to a low level L, respectively in the control period Ts1, and sets the selection signal Sb[m] to a high level H, and the selection signal Sa[m] to a low level L, respectively, in the control period Ts2.

As illustrated in FIG. 14, the drive signal generation unit 51 includes M switching units TX so as to correspond to M discharge units D in one-to-one. The m-th stage of switching unit TX[m] includes a transmission gate TGa[m] that is turned on when the selection signal Sa[m] is a H level and is turned off when L level, and a transmission gate TGb[m] that is turned on when the selection signal Sb[m] is a H level and is turned off when L level.

For example, when the print signal SI[m] indicates (1, 0) (see FIG. 15), the transmission gate TGa[m] is turned on and the transmission gate TGb[m] is turned off in the control period Ts1, and the transmission gate TGa[m] is turned off and the transmission gate TGb[m] is turned on in the control period Ts2.

As illustrated in FIG. 14, the drive waveform signal Com-A is supplied to one end of the transmission gate TGa[m], and the drive waveform signal Com-B is supplied to one end of the transmission gate TGb[m]. Further, the other ends of the transmission gates TGa[m] and TGb[m] are electrically connected to the m-th stage of output end OTN.

Further, as illustrated in FIG. 15, in each control period Ts, the switching unit TX[m] is controlled so as to turn on any one of the transmission gates TGa[m] and TGb[m] and turn off the other one. In other words, in each control period Ts, the switching unit TX[m] supplies any one of the drive waveform signals Com-A and Com-B as the drive signal Vin[m], to the discharge unit D[m], through the m-th stage of output end OTN.

4.2. Drive Waveform Signal

Figure 16:
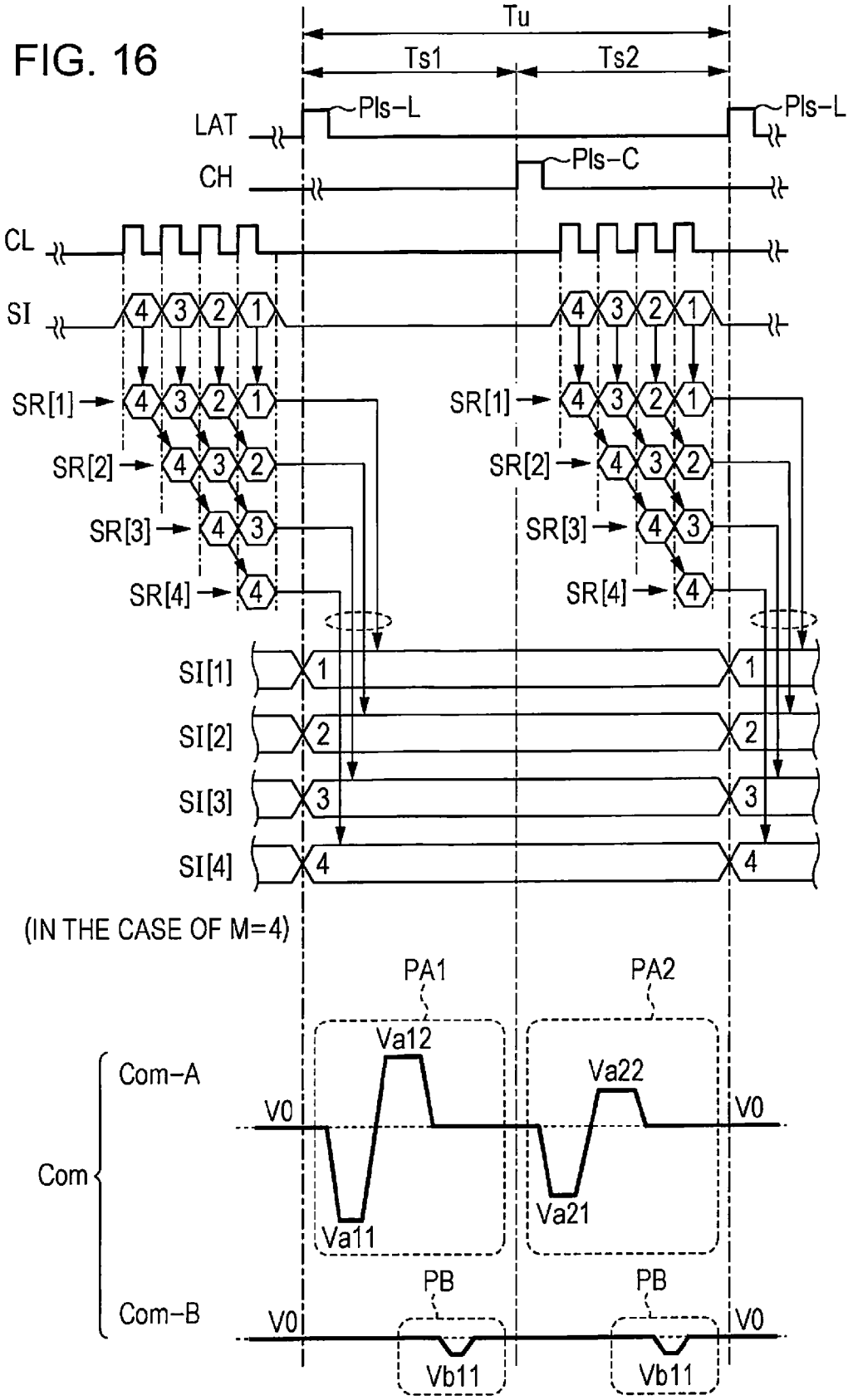
FIG. 16 is a timing chart illustrating an operation of the drive signal generation unit.

FIG. 16 is a timing chart illustrating various signals supplied to the drive signal generation unit 51 by the control unit 6 in each unit period Tu, and the operation of the drive signal generation unit 51 in each unit period Tu. In addition, FIG. 16 illustrates the case of M=4, for convenience of illustration.

As illustrated in FIG. 16, the unit period Tu is divided by a pulse Pls-L that is included in the latch signal LAT, and the control periods Ts1 and Ts2 are divided by a pulse Pls-C that is included in the change signal CH.

The control unit 6 supplies the print signal SI in synchronization with the clock signal CL to the drive signal generation unit 51, prior to the start of each unit period Tu. Then, the shift register SR of the drive signal generation unit 51 sequentially transfers the supplied print signal SI[m] to the subsequent stage in accordance to the clock signal CL.

As illustrated in FIG. 16, the drive waveform signal Com-A, that the control unit 6 outputs in each unit period Tu, includes a discharge waveform PA1 provided in the control period Ts1 (hereinafter, referred to as "waveform PA1"), and a discharge waveform PA2 provided in the control period Ts2 (hereinafter, referred to as "waveform PA2").

The waveform PA1 is a waveform for discharging ink of the medium amount corresponding to a medium dot from the discharge unit D[m] if the drive signal Vin[m] having the waveform PA1 is supplied to the discharge unit D[m].

The waveform PA2 is a waveform for discharging ink of the small amount corresponding to a small dot from the discharge unit D[m] if the drive signal Vin[m] having the waveform PA2 is supplied to the discharge unit D[m].

For example, a potential difference between the lowest potential of the waveform PA1 (in this example, a potential Va11) and the highest potential thereof (in this example, a potential Va12) is greater than a potential difference between the lowest potential of the waveform PA2 (in this example, a potential Va21) and the highest potential thereof (in this example, a potential Va22).

As illustrated in FIG. 16, the drive waveform signal Com-B, that the control unit 6 outputs in each unit period Tu, includes a slight vibration waveform PB (hereinafter, referred to as "waveform PB").

The waveform PB is a waveform not for discharging ink from the discharge unit D[m] if the drive signal Vin[m] having the waveform PB is supplied to the discharge unit D[m]. In other words, the waveform PB is a waveform for causing slight vibration in the ink in the discharge unit D to prevent thickening of the ink. For example, a potential difference between the lowest potential of the waveform PB (in this example, a potential Vb11) and the highest potential thereof (in this example, a reference potential V0) is determined to be smaller than a potential difference between the lowest potential and the highest potential of the waveform PA2.

4.3. Drive Signal

Figure 17:
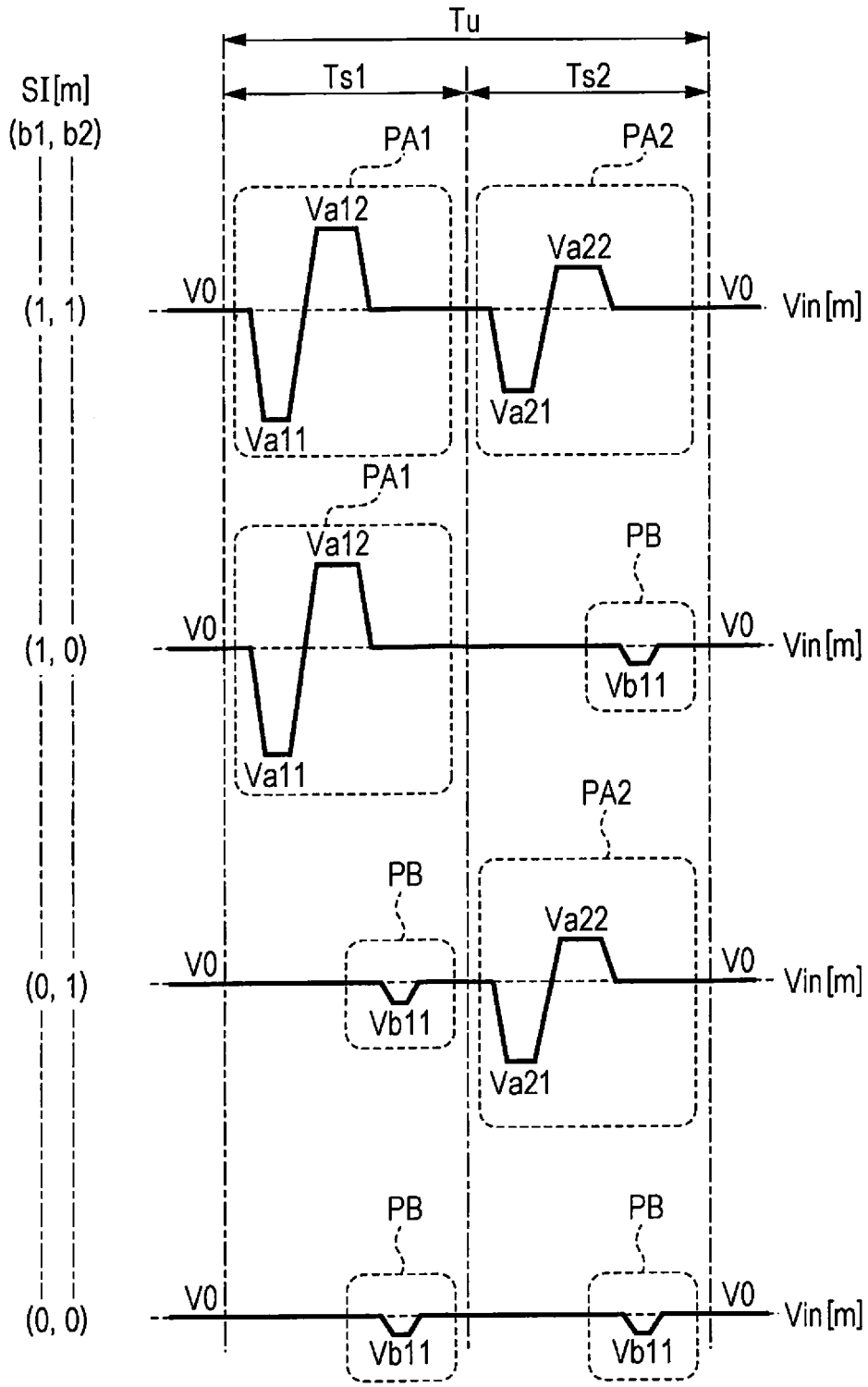
FIG. 17 is a timing chart illustrating a waveform of a drive signal.

Next, the drive signal Vin that the drive signal generation unit 51 outputs in the unit period Tu will be described with reference to FIG. 17.

When the supplied print signal SI[m] in the unit period Tu indicates (1, 1), the switching unit TX[m] selects the drive waveform signal Com-A so as to output the drive signal Vin[m] having the waveform PA1 in the control period Ts1, and selects the drive waveform signal Com-A so as to output the drive signal Vin[m] having the waveform PA2 in the control period Ts2. Thus, in this case, as illustrated in FIG. 17, the drive signal Vin[m] supplied to the discharge unit D[m] in the unit period Tu has the waveform PA1 and the waveform PA2. As a result, the discharge unit D[m] discharges ink of a medium amount based on the waveform PA1, and ink of a small amount based on the waveform PA2, in the unit period Tu, and forms a large dot on the recording sheet P by discharging ink twice.

When the supplied print signal SI[m] in the unit period Tu indicates (1, 0), the switching unit TX[m] selects the drive waveform signal Com-A so as to output the drive signal Vin[m] having the waveform PA1 in the control period Ts1, and selects the drive waveform signal Com-B so as to output the drive signal Vin[m] having the waveform PB in the control period Ts2. Thus, in this case, as illustrated in FIG. 17, the drive signal Vin[m] supplied to the discharge unit D[m] in the unit period Tu has the waveform PA1 and the waveform PB. As a result, the discharge unit D[m] discharges ink of a medium amount based on the waveform PA1, in the unit period Tu, and forms a medium dot on the recording sheet P.

Further, when the supplied print signal SI[m] in the unit period Tu indicates (0, 1), the switching unit TX[m] selects the drive waveform signal Com-B so as to output the drive signal Vin[m] having the waveform PB in the control period Ts1, and selects the drive waveform signal Com-A so as to output the drive signal Vin[m] having the waveform PA2 in the control period Ts2. Thus, in this case, as illustrated in FIG. 17, the drive signal Vin[m] supplied to the discharge unit D[m] in the unit period Tu has the waveform PA2. As a result, the discharge unit D[m] discharges ink of a small amount based on the waveform PA2, in the unit period Tu, and forms a small dot on the recording sheet P.

Further, when the supplied print signal SI[m] in the unit period Tu indicates (0, 0), the switching unit TX[m] selects the drive waveform signal Com-B so as to output the drive signal Vin[m] having the waveform PB in the control periods Ts1 and Ts2. Thus, in this case, as illustrated in FIG.

17, the drive signal Vin[m] supplied to the discharge unit D[m] in the unit period Tu has the waveform PB. As a result, the discharge unit D[m] does not discharge ink in the unit period Tu, and does not form a dot on the recording sheet P (non-recording).

In addition, the control unit 6, a target discharge unit Dtg for which residual vibration in the discharge state determination process is detected in the unit period Tu, among the discharge units D[m] to which the drive signal Vin[m] having the waveform PA1 is supplied, in other words, the discharge units D[m] to which the drive signal SI[m] indicating that the value of the print signal SI[m] is (1, 1) or (1, 0) is supplied, in the unit period Tu. In other words, in the present embodiment, the waveform PA1 of the drive signal Vin[m] that is supplied to the discharge unit D[m] designated as the target discharge unit Dtg has a role of a determination drive waveform (an example of "drive waveform") which is a waveform for driving the target discharge unit Dtg, for which residual vibration in the discharge state determination process is detected, to generate residual vibration.

4.4. Connecting Unit

Figure 18:
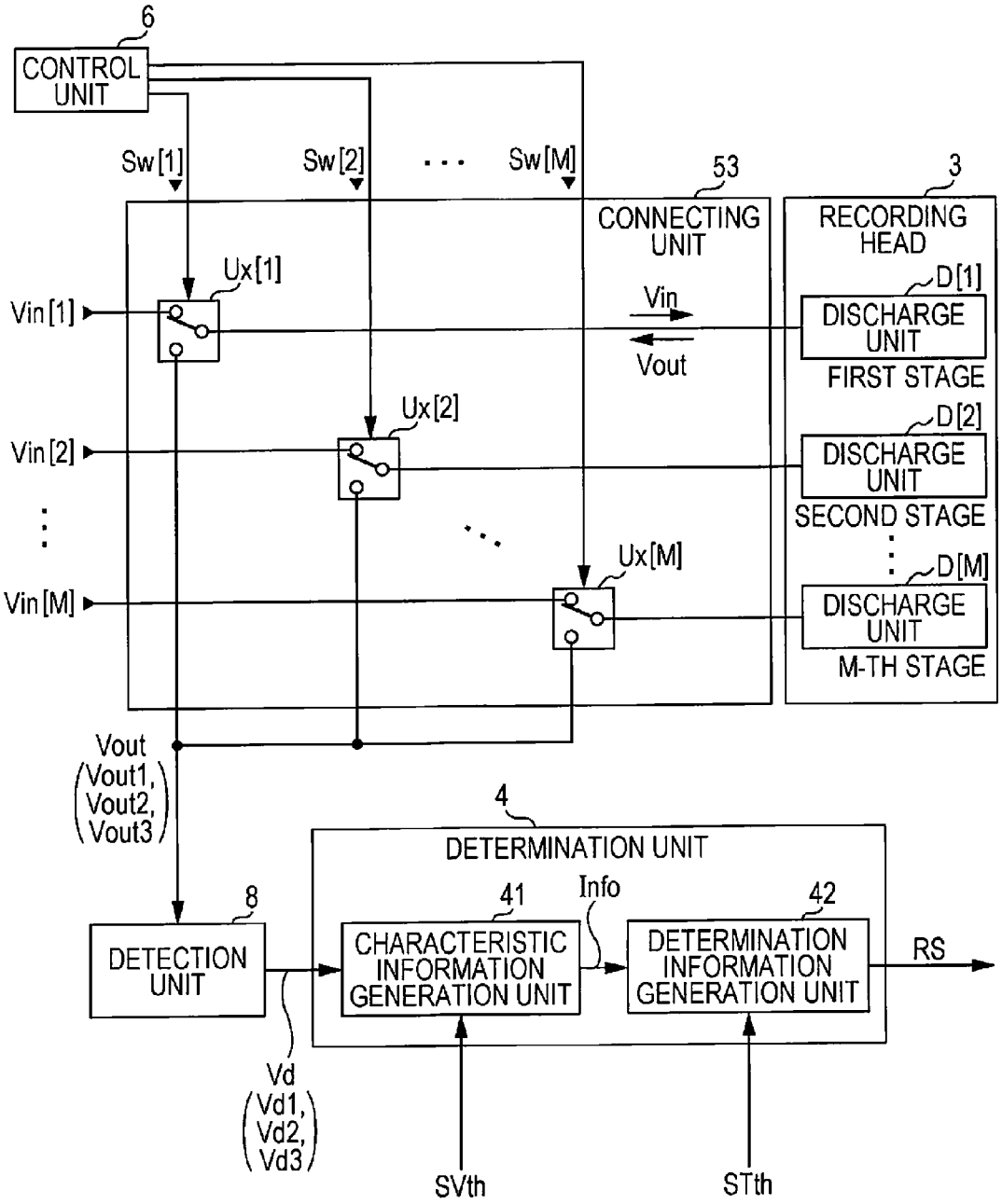
FIG. 18 is an explanatory diagram illustrating a connection relationship between a connecting unit and a detection unit.

FIG. 18 is a block diagram illustrating the configuration of the connecting unit 53, the determination unit 4, and the connection relationship between the recording head 3, the connecting unit 53, the detection unit 8, and the determination unit 4.

As illustrated in FIG. 18, the connecting unit 53 includes M connection circuits Ux (Ux[1], Ux[2], . . . , Ux[M]) of the first to the M-th stages corresponding to the M discharge units D in one-to-one. The m-th stage of connection circuit Ux[m] electrically connects the upper electrode 302 of the piezoelectric element 300 of the discharge unit D[m] to the m-th stage of output end OTN included in the drive signal generation unit 51 or the detection unit 8.

Hereinafter, a state where the connection circuit Ux[m] connects the discharge unit D[m] to the m-th stage of output end OTN of the drive signal generation unit 51 is referred to as a first connection state. Further, a state where the connection circuit Ux[m] connects the discharge unit D[m] to the detection unit 8 is referred to as a second connection state.

When the control unit 6 designates the discharge unit D[m] as the target discharge unit Dtg in the unit period Tu, it is the second connection state in the detection period Td of the unit period Tu, and thus the connection circuit Ux[m] electrically connects the discharge unit D[m] to the detection unit 8. Further, when the control unit 6 designates the discharge unit D[m] as the target discharge unit Dtg in the unit period Tu, it is the first connection state in a period other than the detection period Td of the unit period Tu, and thus the connection circuit Ux[m] electrically connects the discharge unit D[m] to the drive signal generation unit 51. Meanwhile, when the control unit 6 does not designate the discharge unit D[m] as the target discharge unit Dtg in the unit period Tu, it is the first connection state over the entire period of the unit period Tu, and the connection circuit Ux[m] electrically connects the discharge unit D[m] to the drive signal generation unit 51.

The control unit 6 outputs a connection control signal Sw for controlling the connection state of each connection circuit Ux, to each connection circuit Ux.

Specifically, when the control unit 6 designates the discharge unit D[m] as the target discharge unit Dtg in the unit period Tu, the connection circuit Ux[m] supplies a connection control signal Sw[m] so as to be in the first connection state in a period other than the detection period Td, of the unit period Tu, and be in the second connection state in the detection period Td, to the connection circuit Ux[m]. Therefore, when the discharge unit D[m] is designated as the target discharge unit Dtg in the unit period Tu, the drive signal Vin[m] is supplied from the drive signal generation unit 51 to the discharge unit D[m] in the period other than the detection period Td of the unit period Tu, and the residual vibration signal Vout is supplied from the discharge unit D[m] to the detection unit 8 in the detection period Td of the unit period Tu.

Further, when the control unit 6 does not designate the discharge unit D[m] as the target discharge unit Dtg in the unit period Tu, the connection circuit Ux[m] supplies a connection control signal Sw[m] for maintaining the first connection state over the entire period of the unit period Tu, to the connection circuit Ux[m].

In addition, the details will be described later, but in the present embodiment, the detection period Td includes a detection period Td1 (an example of "first period"), a detection period Td2 (an example of "second period"), and a detection period Td3 (an example of "third period") (see FIG. 19).

In addition, in the present embodiment, as illustrated in FIG. 18, it is assumed a case where the ink jet printer 1 includes one detection unit 8 for the M discharge units D, and each detection unit 8 is able to detect only the residual vibration occurring in a single discharge unit D in one unit period Tu. In other words, the control unit 6 according to the present embodiment designates a single discharge unit D of the M discharge units D as the target discharge unit Dtg, in one unit period Tu.

4.5. Detection Unit

The detection unit 8 illustrated in FIG. 18, as described above, generates a waveform shaping signal Vd, based on the residual vibration signal Vout. As described above, the waveform shaping signal Vd is a signal obtained by shaping the residual vibration signal Vout into a waveform suitable for process by the determination unit 4, by amplifying the amplitude of the residual vibration signal Vout, and removing noise components from the residual vibration signal Vout.

The detection unit 8 may have, for example, a configuration including a negative feedback amplifier that amplifies the residual vibration signal Vout, a low-pass filter that attenuates high frequency components of the residual vibration signal Vout, and a voltage follower that converts an impedance and outputs a waveform shaping signal Vd of a low impedance.

In the following, there is a case where a residual vibration signal Vout that is detected in the detection period Td1 is referred to as a residual vibration signal Vout1, a residual vibration signal Vout that is detected in the detection period Td2 is referred to as a residual vibration signal Vout2, and a residual vibration signal Vout that is detected in the detection period Td3 is referred to as a residual vibration signal Vout3, among residual vibration signals Vout that are detected from the discharge unit D[m] that is designated as the target discharge unit Dtg, in the detection period Td of the unit period Tu.

Further, there is a case in the detection unit 8, a waveform shaping signal Vd that is generated based on a residual vibration signal Vout1 is referred to as a waveform shaping signal Vd1 (an example of "first detection signal"), a waveform shaping signal Vd that is generated based on a residual vibration signal Vout2 is referred to as a waveform shaping signal Vd2 (an example of "second detection signal"), and a waveform shaping signal Vd that is generated based on a residual vibration signal Vout3 is referred to as a waveform shaping signal Vd3 (an example of "third detection signal"), among waveform shaping signals Vd that are generated based on the residual vibration signals Vout.

4.6. Determination Unit

The determination unit 4 determines the discharge state of ink of the discharge unit D, based on the waveform shaping signal Vd that is output by the detection unit 8, and generates the determination information RS indicating the determination result.

As illustrated in FIG. 18, the determination unit 4 includes a characteristic information generation unit 41 that generates characteristic information Info indicating the residual vibration occurring in the discharge unit D[m], and a determination information generation unit 42 that determines the ink discharge state of the discharge unit D[m], and generates the determination information RS[m] indicating the determination result.

Among them, a threshold potential signal SVth indicating various threshold potentials used for specifying the characteristics of the residual vibration indicated by the waveform shaping signal Vd is supplied to the characteristic information generation unit 41 from the control unit 6. The characteristic information generation unit 41 specifies the characteristics of the residual vibration indicated by the waveform shaping signal Vd that is generated by the detection unit 8, by comparing various threshold potentials indicated by the threshold potential signal SVth with the potential indicated by the waveform shaping signal Vd, and generates characteristic information Info indicating the characteristics of the specified residual vibration.

The standard information STth indicating the determination standard of the discharge state of ink of the discharge unit D is supplied to the determination information generation unit 42 from the control unit 6. The determination information generation unit 42 determines the ink discharge state of the discharge unit D[m] by comparing the characteristic information Info that is generated by the characteristic information generation unit 41 with the standard value indicated by the standard information STth, and generates the determination information RS[m] indicating the determination result.

5. Ejection State Determination Process

Next, the discharge state determination process will be described with reference to FIGS. 19 to 22C.

As described above, the discharge state determination process is a series of processes executed by the ink jet printer 1, in which the discharge unit D[m] designated as the target discharge unit Dtg is driven in response to the drive signal Vin[m] of a waveform PA1 which is a determination drive waveform, the detection unit 8 detects the residual vibration occurring in the discharge unit D[m], and the determination unit 4 generates determination information RS[m] indicating the ink discharge state of the discharge unit D[m], based on the detection result of the detection unit 8.

In the following, first, with reference to FIG. 19, the waveform PA1 which is a determination drive waveform having the drive signal Vin[m] supplied to the target discharge unit Dtg [m] in the discharge state determination process, and a detection period Td for detecting the residual vibration occurring in the target discharge unit Dtg will be described.

Figure 19:
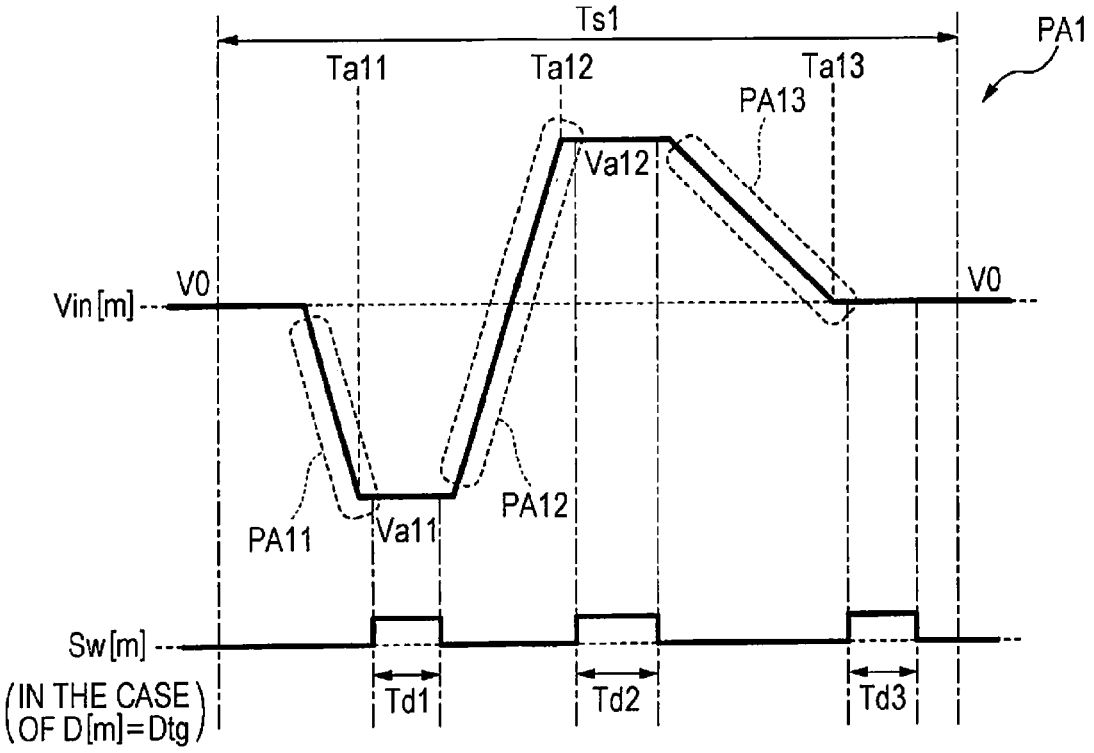
FIG. 19 is a timing chart illustrating a waveform.

FIG. 19 is a timing chart illustrating the details of the waveform PA1 illustrated in FIG. 16, which is an example of the determination drive waveform. As illustrated in FIG. 19, the waveform PA1 which indicates a reference potential V0 at timing when the waveform PA1 is started, becomes a potential Va11 (an example of "first potential") lower than the reference potential V0 from then until timing Ta11, becomes a potential Va12 (an example of "second potential") higher than the potential Va11 from then until timing Ta12, becomes a reference potential V0 (an example of "third potential") lower than the potential Va12 from then until timing Ta13, and maintains the reference potential V0 from then until the waveform PA1 is ended.

Further, as described above, detection periods Td1, Td2, and Td3 are provided in the unit period Tu, as a detection period Td for detecting the residual vibration. Specifically, in the present embodiment, as illustrated in FIG. 19, a detection period Td1 is set to a portion of a period in which the waveform PA1 is maintained in the potential Va11 during a period from timing Ta11 to timing Ta12 of the waveform PA1, a detection period Td2 is set to a portion of a period in which the waveform PA1 is maintained in the potential Va12 during a period from the timing Ta12 to timing Ta13 of the waveform PA1, and a detection period Td3 is set to a portion of a period in which the waveform PA1 is maintained in the reference potential V0 during a period later than the timing Ta13 of the waveform PA1. Further, in the present embodiment, it is assumed that any of the detection periods Td1, Td2, and Td3 is a period shorter than one cycle of the residual vibration signal Vout (see FIG. 20). Further, in the present embodiment, as illustrated in FIG. 19, since a potential indicated by the waveform PA1 is maintained constant in each period of the detection periods Td1, Td2, and Td3, the superimposition of noise on the detected residual vibration is prevented, thereby enabling accurate detection of the residual vibration.

When the discharge unit D[m] is designated as the target discharge unit Dtg, the control unit 6 supplies a connection control signal Sw[m] for causing the switching unit TX[m] to be in a second connection state in the detection periods Td1, Td2, and Td3 out of the unit period Tu, and to be in a first connection state in periods other than the detection periods Td1, Td2, and Td3 out of the unit period Tu, to the switching unit TX[m].

In addition, in the following, as illustrated in FIG. 19, in the waveform PA1, a waveform that changes from a reference potential V0 to a potential Va11 between the start of the waveform PA1 and timing Ta11 is referred to as a waveform PAH (an example of "first waveform"), a waveform that changes from the potential Va11 to a potential Va12 between the timing Ta11 and timing Ta12 is referred to as a waveform PA12 (an example of "second waveform"), and a waveform that changes from the potential Va12 to a reference potential V0 between the timing Ta12 and timing Tali is referred to as a waveform PA13 (an example of "third waveform").

Next, residual vibration signals Vout (residual vibration signals Vout1, Vout2, and Vout3) that are detected at respective detection periods Td1, Td2, and Td3 will be described with reference to FIG. 20. Incidentally, the relationship between the shape of the waveform PA1 exemplified as the determination drive waveform and the waveform of the residual vibration occurring in the discharge unit D[m], illustrated in FIG. 20, is only an example, and the present invention is not intended to be limited to the case illustrated in FIG. 20.

Figure 20:
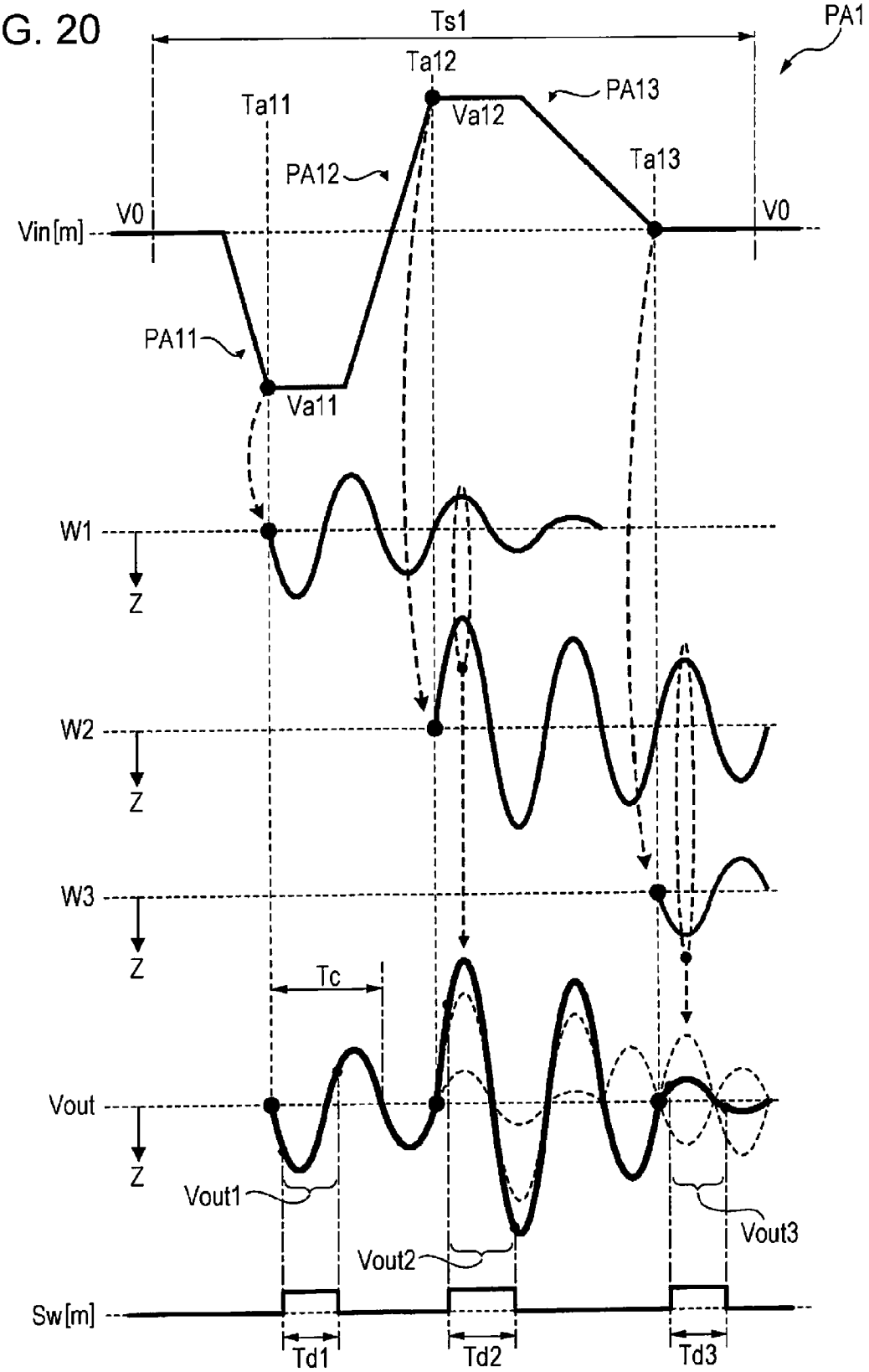
FIG. 20 is an explanatory diagram illustrating residual vibration occurring in the discharge unit of which discharge state is normal.

In the example illustrated in FIG. 20, it is assumed a case where residual vibration W1 due to the waveform PA11 occurs in the discharge unit D[m] that is driven in response to the drive signal Vin[m] having the waveform PA1, at timing Ta11 when the waveform PA11 is ended. For example, in the example illustrated in FIG. 20, the vibrating plate 310 initiates a displacement in +Z direction at the timing Ta11, and thereafter, residual vibration W1 occurs in which the vibrating plate 310 vibrates in −Z direction and +Z direction. Then, in the example illustrated in FIG. 20, residual vibration W1 is detected as a residual vibration signal Vout1 in the detection period Td1 that is set later than the timing Ta11.

Figure 21:
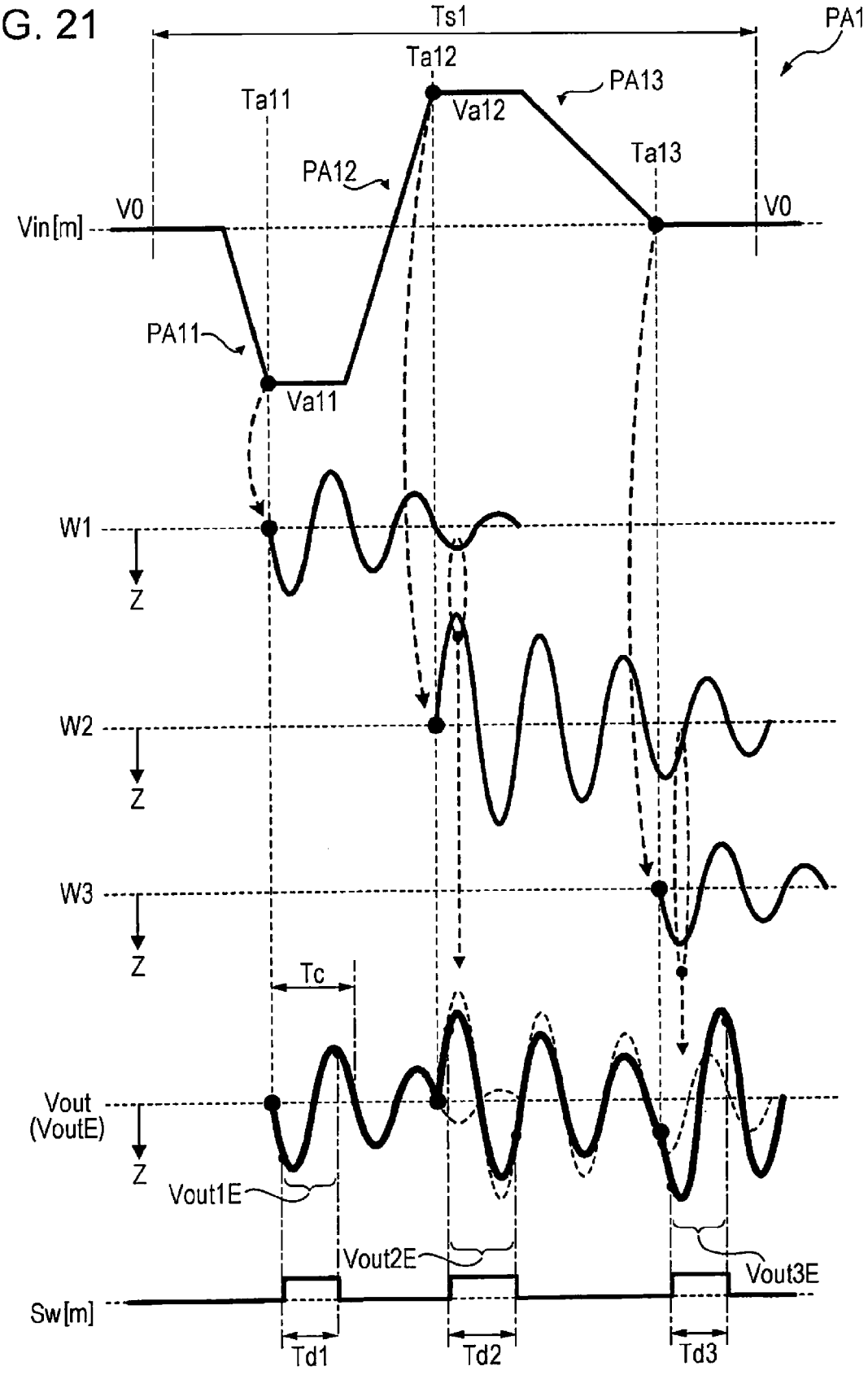
FIG. 21 is an explanatory diagram illustrating residual vibration occurring in the discharge unit of which discharge state is abnormal.

Further, in the example illustrated in FIG. 21, it is assumed a case where residual vibration W2 due to the waveform PA12 occurs in the discharge unit D[m] that is driven in response to the drive signal Vin[m] having the waveform PA1, at timing Ta12 when the waveform PA12 is ended. Then, in the example illustrated in FIG. 20, composite vibration in which the residual vibration W1 and the residual vibration W2 are superimposed is detected as the residual vibration signal Vout2, in the detection period Td2.

Further, in the example illustrated in FIG. 20, it is assumed a case where residual vibration W3 due to the waveform PA13 occurs in the discharge unit D[m] that is driven in response to the drive signal Vin[m] having the waveform PA1, at timing Ta13 when the waveform PA13 is ended. Then, in the example illustrated in FIG. 20, composite vibration in which the residual vibrations W1, W2 and W3 are superimposed is detected as the residual vibration signal Vout3, in the detection period Td3.

Incidentally, the occurrence of the residual vibration in the discharge unit D[m] is assumed as for example, cases exemplified as the following (1) to (3).

(1) a case of transition from a state in which the signal level of the drive signal Vin[m] is changed to a state in which the signal level of the drive signal Vin[m] is held constant, (2) a case of transition from the state in which the signal level of the drive signal Vin[m] is held constant to the state in which the signal level of the drive signal Vin[m] is changed, and (3) a case where the signal level of the drive signal Vin[m] is changed In other words, in the case of supplying the drive signal Vin[m] to the discharge unit D[m] as illustrated in FIG. 19, there is a possibility that the residual vibration occurs in the discharge unit D[m], in addition to the residual vibrations W1, W2, and W3, for example, even at a timing when the waveform PA11 is started, a timing when the waveform PA12 is started, and a timing when the waveform PA13 is started.

However, in the example illustrated in FIG. 20 and FIG. 21 that will be described later, for simplicity, it is assumed that only residual vibrations W1, W2, and W3 occurring in the above case (1) are exemplified and described, among residual vibrations that may occur in the discharge unit D.

Further, in the examples illustrated in FIGS. 19 to 21, it is assumed a case where if the discharge state of ink of the discharge unit D is normal, the waveform PA1 is designed to be a waveform in which the residual vibration W1 and the residual vibration W2 are strengthened with each other. For example, it is assumed a case where the waveform PA1 according to the present embodiment is designed in consideration of the Helmholtz resonance frequency of the discharge unit D such that the phases of the residual vibration W1 and the residual vibration W2 are substantially equal. For example, as illustrated in FIG. 20, it is assumed a case where the duration from the timing Ta11 to the timing Ta12 is substantially equal to (ka−½) times the period of the residual vibration signal Vout when the discharge state of the discharge unit D is normal (ka is a natural number satisfying the 1≤ka).

Further, in the examples illustrated in FIGS. 19 to 21, it is assumed a case where if the discharge state of ink of the discharge unit D is normal, the waveform PA1 is designed to be a waveform in which the residual vibration W2 and the residual vibration W3 are weakened with each other. For example, it is assumed a case where the waveform PA1 according to the present embodiment is designed such that a phase difference between the residual vibration W2 and the residual vibration W3 are substantially equal. For example, as illustrated in FIG. 20, it is assumed a case where the duration from the timing Ta12 to the timing Ta13 is substantially equal to kb times the period of the residual vibration signal Vout when the discharge state of the discharge unit D is normal (kb is a natural number satisfying the 1≤kb).

In this manner, as illustrated in the examples illustrated in FIGS. 19 to 21, if the discharge state of ink of the discharge unit D is normal, the waveform PA1 is designed with consideration of the period of the residual vibration signal Vout such that the amplitude of the residual vibration signal Vout increases in timing Ta12, and decrease in timing Ta13.

If the discharge failure occurs in the discharge unit D, the period of the residual vibration signal Vout varies, as compared with the case where the discharge state of the discharge unit D is normal. In other words, the period of the residual vibration signal Vout when the discharge state of the discharge unit D is abnormal and the period of the residual vibration signal Vout when the discharge state of the discharge unit D is normal are different from each other. For example, in the examples illustrated in FIGS. 19 to 21, the periods of the residual vibrations W1, W2, and W3 when the discharge state of the discharge unit D is abnormal and the periods of the residual vibrations Ni, W2, and W3 when the discharge state of the discharge unit D is normal are different from each other.

FIG. 21 is a diagram illustrating an example when the residual vibrations W1, W2, and W3 vary due to the occurrence of the discharge failure in the discharge unit D[m], as compared with the case where the discharge state of the discharge unit D[m] is normal as illustrated in FIG. 20.

The examples illustrated in FIGS. 20 and 21 exemplifies the case where when the discharge state of the discharge unit D is normal, the residual vibration W1 and the residual vibration W2 are strengthened with each other at the timing Ta12; and when the discharge state of the discharge unit D is abnormal, the residual vibration W1 and the residual vibration W2 are not able to be strengthened with each other at the timing Ta12. In other words, FIGS. 20 and 21 exemplify the case where when the discharge state of the discharge unit D is abnormal, the amount of increase in the amplitude of the residual vibration signal Vout is reduced at timing Ta12, as compared with the case where the discharge state of the discharge unit D is normal. Further, the example illustrated in FIG. 21 illustrates the case where the residual vibration W1 and the residual vibration W2 are weakened with each other at the timing Ta12, and the amplitude of the residual vibration signal Vout at the timing Ta12 is smaller than the amplitude of the residual vibration W2 at the timing Ta12.

Further, in the following description, the residual vibration signal Vout when the discharge state of the discharge unit D is abnormal may be expressed as the residual vibration signal VoutE.

Further, the example illustrated in FIGS. 20 and 21 exemplifies the case where when the discharge state of the discharge unit D is normal, the residual vibration W2 and the residual vibration W3 are weakened with each other at the timing Tali; and when the discharge state of the discharge unit D is abnormal, the residual vibration W2 and the residual vibration W3 are not able to be weakened with each other at the timing Ta13. In other words, FIGS. 20 and 21 exemplifies the case where when the discharge state of the discharge unit D is abnormal, the amount of decrease in the amplitude of the residual vibration signal Vout is reduced at the timing Ta13, as compared with the case where the discharge state of the discharge unit D is normal. Further, the example illustrated in FIG. 21 illustrates the case where the residual vibration W2 and the residual vibration W3 are strengthened with each other at the timing Ta13; and the amplitude of the residual vibration signal VoutE at the timing Ta13 is larger than the amplitude of the residual vibration W2 at the timing Ta13.

As illustrated in FIGS. 20 and 21, when the discharge state of the discharge unit D is abnormal, and the discharge state of the discharge unit D is normal, the cycles of the residual vibration signals Vout are likely to be different, and the signal levels and phases are likely to differ in respective timings of the residual vibration signal Vout. The characteristics of the waveform indicated by the waveform shaping signal Vd, such as the cycle, the signal level, the phase, and the like of the waveform shaping signal Vd are determined depending on the characteristics of the waveform indicated by the residual vibration signal Vout, such as the cycle, the signal level, the phase, and the like of the residual vibration signal Vout. For this reason, the characteristics of the waveform indicated by the waveform shaping signal Vd when the discharge state of the discharge unit D is abnormal, and the characteristics of the waveform indicated by the waveform shaping signal Vd when the discharge state of the discharge unit D is normal are likely to differ. Therefore, it is possible to determine the discharge state of the discharge unit D, based on the characteristics of the waveform indicated by the waveform shaping signal Vd.

Therefore, in the present embodiment, the characteristic information generation unit 41 generates the characteristic information Info indicating on the signal level and the phase of the waveform shaping signal Vd, among the characteristics of the waveform indicated by the waveform shaping signal Vd. Specifically, the characteristic information generation unit 41 according to the present embodiment generates the characteristic information Info including information on a change in the signal level and the phase of the waveform shaping signal Vd1, information on a change in the signal level and the phase of the waveform shaping signal Vd2, and information on a change in the signal level and the phase of the waveform shaping signal Vd3.

Then, when the discharge state of the discharge unit D is normal, the determination information generation unit 42 determines whether or not the characteristics of the waveform indicated by the waveform shaping signal Vd is within the range of the characteristics of the waveform indicated by the waveform shaping signal Vd, based on the characteristic information Info, and generates the determination information RS indicating the determination result. Thus, it is possible to determine whether or not the waveform of the residual vibration signal Vout that is detected by the detection unit 8 can be regarded as the waveform of the residual vibration signal Vout when the discharge state of the discharge unit D is normal, and it is possible to determine the discharge state of ink of the discharge unit D.

In the present embodiment, the characteristic information generation unit 41 compares the signal level of the waveform shaping signal Vd with various threshold potentials indicated by the threshold potential signal SVth, and outputs various measurement times obtained as a result of the comparison, as the characteristic information Info. Then, the determination information generation unit 42 compares various measurement times included in the characteristic information Info with various determination references indicated by the standard information STth, and generates the determination information RS, based on the comparison result.

In addition, the values of various threshold potentials indicated by the threshold potential signal SVth, the details of various measurement times indicated by the characteristic information Info, and the details of various determination references indicated by the standard information STth may be appropriately determined, based on the shape of the determination drive waveform for driving the target discharge unit Dtg, and the characteristics of residual vibration generated in the discharge unit D which is driven in response to the determination drive waveform, in the discharge state determination process. In short, the details of the threshold potential signal SVth, the characteristic information Info, and the standard information STth may be determined in order to distinguish whether the waveform of the residual vibration occurring in the discharge unit D is the shape when the discharge state of the discharge unit D is normal, or the shape when the discharge state of the discharge unit D is abnormal. In addition, when the discharge state of the discharge unit D is abnormal, the details of the threshold potential signal SVth, the characteristic information Info, and the standard information STth may be determined in order to distinguish whether the waveform of residual vibration occurring in the discharge unit D is the shape when bubble is mixed into the cavity 320, the shape when ink in the cavity 320 is thickened, or the shape when foreign matter is adhered to the vicinity of the nozzle N.

Hereinafter, an example of various threshold potentials indicated by the threshold potential signal SVth, an example of various measurement times indicated by the characteristic information Info, and an example of various determination references indicated by the standard information STth will be described with reference to FIGS. 22A to 22C.

Figure 22A:
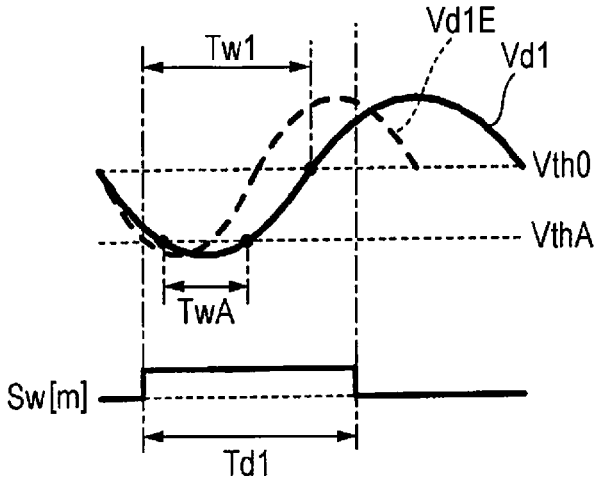
FIGS. 22A to 22C are explanatory diagrams illustrating generation of characteristic information based on a waveform shaping signal.
Figure 22B:
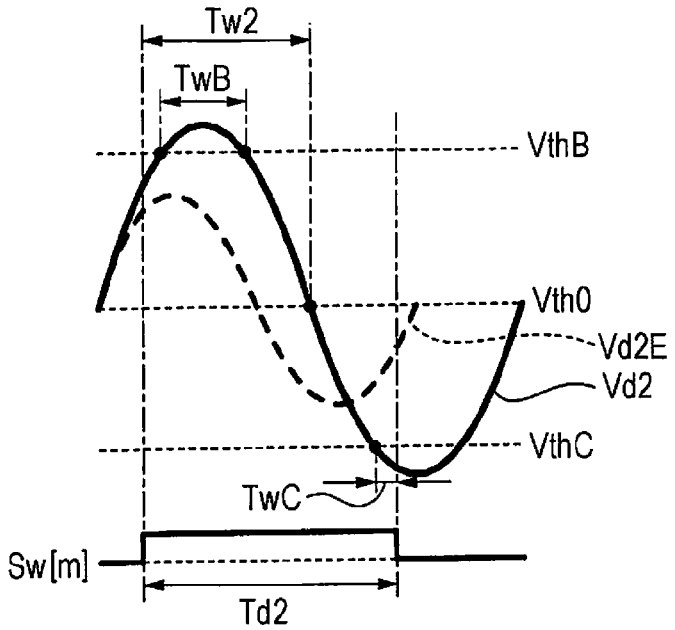
Figure 22C:
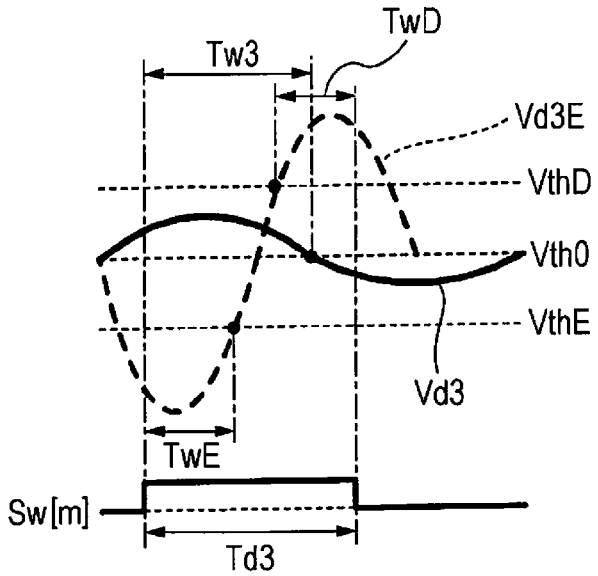

FIGS. 22A to 22C is an explanatory diagram illustrating an example of each of the threshold potential signal SVth, the characteristic information Info, and the standard information STth, which are determined when the waveform PA1 of the drive signal Vin and the waveform of the residual vibration occurring in the discharge unit D are as illustrated in FIGS. 19 to 21. In the example illustrated in FIGS. 22A to 22C, various threshold potentials indicated by the threshold potential signal SVth include threshold potentials Vth0, VthA, VthB, VthC, VthD, and VthE. Further, in the example illustrated in FIGS. 22A to 22C, it is assumed a case where the characteristic information Info indicates measurement times Tw1, Tw2, Tw3, TwA, TwB, TwC, TwD, and TwE. Further, in the following, the waveform shaping signal Vd generated based on the residual vibration signal Vout1 when the discharge state of the discharge unit D is abnormal is referred to as a waveform shaping signal Vd1E (see FIG. 22A), the waveform shaping signal Vd generated based on the residual vibration signal Vout2 when the discharge state of the discharge unit D is abnormal is referred to as a waveform shaping signal Vd2E (see FIG. 22B), and the waveform shaping signal Vd generated based on the residual vibration signal Vout3 when the discharge state of the discharge unit D is abnormal is referred to as a waveform shaping signal Vd3E (see FIG. 22C).

When the waveform PA1 of the drive signal Vin and the waveform of the residual vibration occurring in the discharge unit D are as illustrated in FIGS. 19 to 21, the characteristic information generation unit 41, as illustrated in FIG. 22A, compares the potential indicated by the waveform shaping signal Vd1 with the threshold potentials Vth0 and VthA, and in the detection period Td1, measures the measurement time Tw1 indicating the duration in which the potential of the waveform shaping signal Vd1 is the threshold potential Vth0 or less, and the measurement time TwA indicating the duration in which the potential of the waveform shaping signal Vd1 is the threshold potential VthA or less. In addition, the threshold potential Vth0 is a potential of an amplitude center level of the waveform shaping signal Vd. In addition, the threshold potential VthA is a potential lower than the threshold potential Vth0.

Further, the characteristic information generation unit 41, as illustrated in FIG. 22B, compares the potential indicated by the waveform shaping signal Vd2 with the threshold potentials Vth0, VthB, and VthC, and in the detection period Td2, measures the measurement time Tw2 indicating the duration in which the potential of the waveform shaping signal Vd2 is the threshold potential Vth0 or more, the measurement time TwB indicating the duration in which the potential of the waveform shaping signal Vd2 is the threshold potential VthB or more, and the measurement time TwC indicating the duration in which the potential of the waveform shaping signal Vd2 is the threshold potential VthC or less. In addition, the threshold potential VthB is a potential higher than the threshold potential Vth0. In addition, the threshold potential VthC is a potential lower than the threshold potential Vth0.

Further, the characteristic information generation unit 41, as illustrated in FIG. 22C, compares the potential indicated by the waveform shaping signal Vd3 with the threshold potentials Vth0, VthD, and VthE, and in the detection period Td3, measures the measurement time Tw3 indicating the duration in which the potential of the waveform shaping signal Vd3 is the threshold potential Vth0 or more, the measurement time TwD indicating the duration in which the potential of the waveform shaping signal Vd3 is the threshold potential VthD or more, and the measurement time TwE indicating the duration in which the potential of the waveform shaping signal Vd3 is the threshold potential VthE or less. In addition, the threshold potential VthD is set so as to be a potential higher than the threshold potential Vth0, and a potential higher than the maximum value of the potential of the waveform shaping signal Vd3. In addition, the threshold potential VthE is set so as to be a potential lower than the threshold potential Vth0, and a potential lower than the minimum value of the potential of the waveform shaping signal Vd3.

In this manner, in the example illustrated in FIGS. 22A to 22C, among characteristic information Info, the measurement times Tw1, Tw2, and Tw3 are information indicating so-called characteristics regarding the phase of the waveform shaping signal Vd, indicating the duration at which the signal level of the waveform shaping signal Vd reaches the amplitude center. Further, in the example illustrated in FIGS. 22A to 22C, among characteristic information Info, the measurement times TwA, TwB, TwC, TwD, and TwE is so-called information indicating the characteristics regarding a change in the signal level of the waveform shaping signal Vd, indicating a duration in which the signal level of the waveform shaping signal Vd is the threshold potential or more, or a duration indicating the threshold potential or less.

In the example illustrated in FIGS. 19 to 22C, the determination information generation unit 42 compares the measurement times Tw1, Tw2, Tw3, TwA, TwB, TwC, TwD, and TwE which are measured by the characteristic information generation unit 41, and included in the characteristic information Info, with the standard values Tw1L, Tw1H, Tw2L, Tw2H, Tw3L, Tw3H, TwAL, TwAH, TwBL, TwBH, TwCL, TwCH, TwD0, and TwE0 which are indicated by the standard information STth that is output by the control unit 6, and determines whether or not the waveform indicated by the waveform shaping signal Vd is a waveform based on the residual vibration signal Vout which is detected when the discharge state of the discharge unit D is normal. In addition, the various standard values indicated by the standard information STth are thresholds which are predetermined based on various measurement times indicated by the characteristic information Info that is measured from the waveform shaping signal Vd based on the residual vibration signal Vout when the discharge state of the discharge unit D is normal, and various measurement times indicated by the characteristic information Info that is measured from the waveform shaping signal VdE based on the residual vibration signal VoutE when the discharge state of the discharge unit D is abnormal, for distinguishing them from each other.

In the example illustrated in FIGS. 19 to 22C, when various measurement times included in the characteristic information Info satisfy all the following Equations (1) to (8), the determination information generation unit 42 determines that the discharge state of the discharge unit D is normal, and generates determination information RS[m] indicating the determination result.

When various measurement times included in the characteristic information Info do not satisfy any one of the following Equations (1) to (8), the determination information generation unit 42 determines that the discharge state of the discharge unit D is abnormal, and generates determination information RS[m] indicating the determination result.

$$Tw1L \leq Tw1 \leq Tw1H \quad (1)$$

$$Tw2L \leq Tw2 \leq Tw2H \quad (2)$$

$$Tw3L \leq Tw3 \leq Tw3H \quad (3)$$

$$TwAL \leq TwA \leq TwAH \quad (4)$$

$$TwBL \leq TwB \leq TwBH \quad (5)$$

$$TwCL \leq TwC \leq TwCH \quad (6)$$

$$TwD = TwD0 \text{ (here, } TwD0 = 0) \quad (7)$$

$$TwE = TwE0 \text{ (here, } TwE0 = 0) \quad (8)$$

In this way, in the discharge state determination process, the control unit 6 controls the head driver 5 so as to supply the drive signal Vin[m] having the waveform PA1 which is the determination drive waveform, to the discharge unit D[m] designated as the target discharge unit Dtg. Then, the control unit 6 generates characteristic information Info, based on the waveform shaping signal Vd1 representing the residual vibration occurring in the discharge unit D[m] in the detection period Td1, the waveform shaping signal Vd2 representing the residual vibration occurring in the discharge unit D[m] in the detection period Td2, and the waveform shaping signal Vd3 representing the residual vibration occurring in the discharge unit D[m] in the detection period Td3. Then, the control unit 6 determines an ink discharge state of the discharge unit D[m], based on the characteristic information Info, and generates the determination information RS[m] representing the determination result.

6. Conclusion of Embodiment

As described in the above, in the present embodiment, the discharge state of ink of the discharge unit D is determined based on the phase and the signal level of the residual vibration occurring in the discharge unit D. In other words, in the present embodiment, the discharge state of the discharge unit D is measured, without measuring the time of one cycle of the residual vibration occurring the discharge unit D. Thus, even when each of the detection periods Td1, Td2, Td3 constituting the detection period Td is shorter than the interval of the residual vibration occurring in the discharge unit D, it is possible to specify the characteristics of the residual vibration occurring in the discharge unit D, and to determine the discharge state of the discharge unit D, based on the characteristics of the specified residual vibration.

However, as in the discharge state determination process in the related art, an aspect of determining the discharge state based on time of one cycle of the residual vibration occurring in the discharge unit D is also contemplated (hereinafter, the aspect is referred to as "comparative example"). In the comparative example, generally, one detection period having a duration longer than the one cycle of the residual vibration is provided in order to detect at least one cycle of the residual vibration, in the determination drive waveform. In general, the signal level of the determination drive waveform is maintained constant, in order to accurately detect the residual vibration, in one detection period. In other words, in the determination drive waveform according to the comparative example, in general, the detection waveform having a signal level to be maintained substantially constant is provided corresponding to one detection period longer than the cycle of the residual vibration.

Therefore, in the comparative example, when the printing waveform such as the discharge waveform used in the printing process and the determination drive waveform used in the discharge state determination process are common, there is a constraint of ensuring a detection waveform having a duration of one cycle of the residual vibration or more in the printing waveform, such that it is difficult to shorten the interval of the printing waveform, thus, in some cases, it is difficult to speed the printing process. Thus, in the comparative example, the determination drive waveform and the printing waveform are set to separate waveforms in order to speed the printing process, and it is inevitable to perform the printing process and the discharge state determination process at different timings, such that the user of the ink jet printer 1 may feel uncomfortable in some cases.

In contrast, in the present embodiment, three detection periods Td1, Td2, Td3 shorter than the period of residual vibration are provided in a distributed manner for the determination drive waveform, instead of providing one detection period longer than the period of the residual vibration.

Therefore, in the present embodiment, the constraint of providing a detection waveform for detecting the residual vibration in the determination drive waveform is reduced, as compared with the comparative example, and it is possible to increase the degree of freedom in the waveform design. That is, in the present embodiment, it is easier to shorten the period of determination drive waveform, as compared with the comparative example, and even when the discharge state determination process and the printing waveform are common, it becomes easy to shorten the periods of the determination drive waveform (and the printing waveform). Therefore, in the present embodiment, when speeding the printing process, it becomes possible to perform the discharge state determination process during the execution of the printing process, to rapid treat a discharge failure occurring during the execution of the printing process, and to prevent sudden deterioration in print quality during the execution of the printing process.

In addition, in the present embodiment, since information about the characteristics of the waveform of residual vibration is obtained in the three detection periods Td1, Td2, and, Td3, larger amount of information is acquired, as compared with the case of obtaining the information about the characteristics of the waveform of the residual vibration in one of detection period out of detection periods Td1, Td2, and Td3.

Therefore, it is possible to increase the accuracy of the determination as to whether the waveform of a residual signal corresponds to the waveform when the discharge state is normal, based on the characteristic information Info which is information regarding the characteristics of the waveform of the residual vibration, in other words, the accuracy of the determination of the discharge state of the discharge unit D based on the characteristic information Info.

Furthermore, in the present embodiment, the waveform shaping signal Vd1 corresponding to the residual vibration W1 is detected in the detection period Td1, and the waveform shaping signal Vd2 corresponding to the residual vibration W1 and the residual vibration W2 is detected in the detection period Td2. In other words, in the present embodiment, since the residual vibration W1 and the residual vibration W2 are detected in the detection period Td1 and the detection period Td2, which are provided in a distributed manner, and information about the characteristics of the residual vibration is obtained, it is possible to obtain the larger amount of information, as compared with a case of detecting only the residual vibration W1, and obtaining the information about the characteristics of residual vibration, in one detection period such as to have a duration of the sum of the detection period Td1 and the detection period Td2.

As described in the above, in the present embodiment, due to the provision of the detection waveform, it is possible to improve the amount of information regarding the characteristics of the residual vibration that can be obtained in the detection waveform, while preventing a decrease in the degree of freedom on design of the determination drive waveform.

B. Modification Example

Each of the above embodiments can be variously modified. The specific modification aspects will be described below. Two or more aspects that are arbitrarily selected from the following examples can appropriately be combined within a range in which they are not mutually inconsistent.

Incidentally, elements in the modification examples having the same effects and functions as in the embodiment are denoted by using the reference symbols referred to in the above description, and thus the detailed description thereof will appropriately be omitted.

MODIFICATION EXAMPLE 1

In the above-described embodiment, the waveform PA11 which is an example of the first waveform is a waveform that is provided before the start of the detection period Td1 that is an example of the first period, and is a waveform which varies from the reference potential V0 to the potential Va11 which is an example of the first potential, but the present invention is not limited to such an aspect, the first waveform may be a waveform that is provided before the start of the first period, and may be a waveform which varies from a potential different from the first potential to the first potential. In this case, it is preferable that the first waveform is a waveform that is provided before the start of the first period, and is a waveform which varies from a potential higher than the first potential to the first potential.

Further, in the above-described embodiment, the waveform PA12 which is an example of the second waveform is a waveform that is provided before the start of the detection period Td2 that is an example of the second period, and is a waveform which varies from the potential Va11 which is an example of the first potential to the potential Va12 which is an example of the second potential, but the present invention is not limited to such an aspect, the second waveform may be a waveform that is provided before the start of the second period, and may be a waveform which varies from a potential different from the second potential to the second potential. In this case, it is preferable that the second waveform is a waveform that is provided before the start of the second period, and is a waveform which varies from a potential lower than the second potential to the second potential.

Further, in the above-described embodiment, the waveform PA13 which is an example of the third waveform is a waveform that is provided before the start of the detection period Td3 that is an example of the third period, and is a waveform which varies from the potential Va12 which is an example of the second potential to the reference potential V0 which is an example of the third potential, but the present invention is not limited to such an aspect, and the third waveform may be a waveform that is provided before the start of the third period, and may be a waveform which varies from a potential different from the third potential to the third potential. In this case, it is preferable that the third waveform is a waveform that is provided before the start of the third period, and is a waveform which varies from a potential higher than the third potential to the third potential.

MODIFICATION EXAMPLE 2

In the embodiment and modification example described above, although the potential Va11 which is an example of the first potential is a potential lower than the reference potential V0 which is an example of a third potential, and the potential Va12 which is an example of the second potential is a potential higher than the reference potential V0 which is an example of a third potential, the present invention is not limited to such aspects, and the first potential, the second potential, and the third potential may be any potential. For example, two or more potentials among the first potential, the second potential, and the third potential may be equal potential.

MODIFICATION EXAMPLE 3

In the embodiment and modification examples described above, although each of the detection periods Td1, Td2, and Td3 has a duration shorter than the period of the residual vibration when the discharge state of the discharge unit D is normal, one or more detection periods among detection periods Td1, Td2, and Td3 may have a duration longer than the period of the residual vibration.

MODIFICATION EXAMPLE 4

In the embodiment and modification examples described above, although three detection waveforms are provided in three detection periods Td1, Td2, and Td3, in the determination drive waveform, the present invention is not limited to such aspects, and the determination drive waveform may have two detection waveforms in at least two detection periods. For example, the detection unit 8 may detect the residual vibration signals Vout1 and Vout2, from the discharge unit D[m] to which the drive signal Vin[m] having the determination drive waveform is supplied, in the detection periods Td1 and Td2.

Further, in the embodiment and modification examples described above, the determination drive waveform illustrated as the waveform PA1 includes a first waveform illustrated as a waveform PA11, a second waveform illustrated as a waveform PA12, and a third waveform illustrated as a waveform PA13, but the present invention is not limited to such aspects, the determination drive waveform may include at least two waveforms, among the first waveform, the second waveform, and the third waveform.

MODIFICATION EXAMPLE 5

Further, in the embodiment and modification examples described above, it has been exemplified a case of using the discharge waveform PA1 as the determination drive waveform, among the printing waveforms, but the present invention is not limited to such aspects, a waveform other than the waveform PA1 may be used as the determination drive waveform, among the printing waveforms. For example, the discharge waveform PA2 may be used as the determination drive waveform, and a non-discharge waveform such as a slight vibration waveform PB may be used as the determination drive waveform.

Further, a plurality of printing waveforms may be used as the determination drive waveform. For example, both the discharge waveform PA1 and the discharge waveform PA2 may be used as the determination drive waveform. In this case, for example, since three detection periods are provided in the waveform PA1, and three detection periods are provided in the waveform PA2, six detection periods can be provided in one unit period Tu, and it is possible to further increase the accuracy of the determination of the discharge state, as compared with the above described embodiments.

Further, in the embodiment and modification examples described above, the printing waveform is used as the determination drive waveform, but the determination drive waveform may be a separate waveform from the printing waveform.

In this case, the discharge state determination process may be executed in the unit period Tu in which the printing process is not executed.

MODIFICATION EXAMPLE 6

The embodiment described above has exemplified the case where the characteristic information Info is information about the signal level and phase of the waveform shaping signal Vd, among the characteristics of the waveform indicated by the waveform shaping signal Vd, but the present invention is not limited to such aspects, and the characteristic information Info may be information including at least one of the signal level, the phase, and the period, among the characteristics of the waveform indicated by the waveform shaping signal Vd.

Incidentally, when the characteristic information Info includes information indicating the period of the waveform indicated by the waveform shaping signal Vd, as in Modification example 3, it is preferable that one or more detection periods of the detection periods Td1, Td2, and Td3 have a longer duration than the period of the waveform shaping signal Vd.

MODIFICATION EXAMPLE 7

The ink jet printer 1 according to the embodiment and modification examples described above includes four detection units 8, and four determination units 4, for four recording heads 3, but the present invention is not limited to such aspects, and the ink jet printer 1 may be configured to include five or more detection units 8, and five or more determination units 4, for four recording heads 3, or on the contrary, may be configured to include three or less detection units 8, and three or less determination units 4, for four recording heads 3.

MODIFICATION EXAMPLE 8

The ink jet printer 1 according to the embodiment and modification examples described above is a line printer including the nozzle array Ln provided such that the range YNL includes a range YP, but the present invention is not limited to such aspects, the ink jet printer 1 may be a serial printer that performs a printing process by the recording head 3 reciprocating in the Y-axis direction.

MODIFICATION EXAMPLE 9

The ink jet printer 1 according to the embodiment and modification examples described above is capable of discharging inks of four colors of CMYK, but the present invention is not limited to such aspects, and the ink jet printer 1 may be capable of discharging at least one or more colors of ink, and the color of the ink may be color other than CMYK.

In addition, the ink jet printer 1 according to the embodiment and modification example described above is provided with a nozzle array Ln of four arrays, but may be provided with a nozzle array Ln of at least one array.

MODIFICATION EXAMPLE 10

In the embodiment and modification examples described above, the drive waveform signal Com includes the signal of two systems of the drive waveform signals Com-A and Com-B, but the present invention is not intended to be limited to such embodiments, and the drive waveform signal Com may include a signal of one or more systems. In other words, the drive waveform signal Com may be a signal of one system, for example, a signal including only one drive waveform signal Com-A, a signal of three or more systems, for example, a signal including the drive waveform signals Com-A, Com-B, and Com-C. In this case, the determination drive waveform may be provided in any one signal of the drive waveform signals Com-A, Com-B, and Com-C.

In the embodiment and modification examples described above, the unit period Tu includes two control periods Ts1 and Ts2, but the present invention is not limited to such aspects, and the unit period Tu may be made of a single control period, or may include three or more of control periods Ts. In this case, the determination drive waveform may be provided in any one control period Ts.

Further, in the embodiment and modification examples described above, the print signal SI[m] is a two-bit signal, but the number of bits of the print signal SI[m] may be determined appropriately according to the gray scale to be displayed, the number of control periods Ts included in the unit period Tu, the number of systems of the signal included in the drive waveform signal Com, or the like.

MODIFICATION EXAMPLE 11

In the embodiment and modification examples described above, the determination information generation unit 42 is implemented as an electronic circuit, but may be implemented as a functional block realized by the CPU of the control unit 6 operating according to the control program.

Similarly, the characteristic information generation unit 41 may be implemented as a functional block realized by the CPU of the control unit 6 operating according to a control program. In this case, it is preferable that the detection unit 8 is provided with an AD converter, which outputs the waveform shaping signal Vd as a digital signal.

What is claimed is:

1. A liquid discharge apparatus comprising:

a discharge unit including a piezoelectric element that is displaced in response to a drive signal, a pressure chamber of which an inner pressure is increased or decreased by the piezoelectric element, and a nozzle which is in communication with the pressure chamber and discharges liquid filling the pressure chamber, depending on an increase or a decrease in the inner pressure of the pressure chamber;

a detection unit that detects residual vibration occurring in the discharge unit according to a potential change of the drive signal that is supplied to the piezoelectric element; and a determination unit that determines a discharge state of the liquid in the discharge unit, depending on a detection result of the detection unit, the detection unit outputting a first detection signal indicating a detection result of residual vibration in the discharge unit from a first timing, the first timing being a timing after a potential of the drive signal supplied to the piezoelectric element reaches a first potential from a potential different from the first potential to a second timing, between which the drive signal is kept at the first potential, and a second detection signal indicating a detection result of residual vibration in the discharge unit from a third timing, the third timing being a timing after the potential of the drive signal supplied to the piezoelectric element reaches a second potential from a potential different from the second potential to a fourth timing, between which the drive signal is kept at the second potential, and the determination unit determining the discharge state of the liquid in the discharge unit, based on the first detection signal and the second detection signal.

2. The liquid discharge apparatus according to claim 1, wherein the determination unit determines the discharge state of the liquid in the discharge unit, depending on a phase of residual vibration indicated by the first detection signal, a magnitude of a change in a signal level indicated by the first detection signal, a phase of residual vibration indicated by the second detection signal, and a magnitude of a change in a signal level indicated by the second detection signal.

3. The liquid discharge apparatus according to claim 1, wherein when a drive signal having a waveform that changes to the first potential or the second potential is supplied to the piezoelectric element, the discharge unit discharges liquid filling the pressure chamber from the nozzle.

4. The liquid discharge apparatus according to claim 1, wherein the first detection signal indicates a potential of a shaping signal which is shaped based on the residual vibration from the first timing, and the second detection signal indicates a potential of a shaping signal which is shaped based on the residual vibration from the third timing.

5. A liquid discharge apparatus comprising:

a discharge unit including a piezoelectric element that is displaced in response to a drive signal, a pressure chamber of which an inner pressure is increased or decreased by the piezoelectric element, and a nozzle which is in communication with the pressure chamber and discharges liquid filling the pressure chamber, depending on an increase or a decrease in the inner pressure of the pressure chamber;

a detection unit that outputs a first detection signal indicating a detection result of residual vibration occurring in the discharge unit in a first period, and a second detection signal indicating a detection result of residual vibration occurring in the discharge unit in a second period, when a drive signal is supplied to the piezoelectric element, the drive signal having a drive waveform which is a first potential in the first period and is a second potential in the second period, the first potential during the first period being constant, the second potential during the second period being constant; and a determination unit that determines a discharge state of liquid in the discharge unit, based on the first detection signal and the second detection signal.

6. The liquid discharge apparatus according to claim 5, wherein the drive waveform includes a first waveform that changes to the first potential from a potential different from the first potential, prior to a start of the first period, and a second waveform that changes to the second potential from a potential different from the second potential, prior to a start of the second period after an end of the first period, wherein the first detection signal indicates a detection result of residual vibration caused by the first waveform occurring in the discharge unit, and wherein the second detection signal indicates a detection result of composite vibration of residual vibration caused by the first waveform occurring in the discharge unit and residual vibration caused by the second waveform occurring in the discharge unit.

7. The liquid discharge apparatus according to claim 5, wherein at least one period of the first period and the second period is shorter than a period of residual vibration occurring in the discharge unit, in the first period or the second period, if the discharge state of the liquid in the discharge unit is normal.

8. A control method of a liquid discharge apparatus, the liquid discharge apparatus including a discharge unit including a piezoelectric element that is displaced in response to a drive signal, a pressure chamber of which an inner pressure is increased or decreased by the piezoelectric element, and a nozzle which is in communication with the pressure chamber and discharges liquid filling the pressure chamber, depending on an increase or a decrease in the inner pressure of the pressure chamber, the control method comprising:

detecting residual vibration in the discharge unit from a first timing, the first timing being a timing after a potential of the drive signal supplied to the piezoelectric element reaches a first potential from a potential different from the first potential to a second timing, between which the drive signal is kept at the first potential;

outputting a first detection signal representing the detection result;

detecting residual vibration in the discharge unit from a third timing, the third timing being a timing after the potential of the drive signal supplied to the piezoelectric element reaches a second potential from a potential different from the second potential to a fourth timing, between which the drive signal is kept at the second potential;

outputting a second detection signal representing the detection result; and determining a discharge state of liquid in the discharge unit, based on the first detection signal and the second detection signal.

9. A non-transitory computer-readable medium storing control program of a liquid discharge apparatus, the liquid discharge apparatus including a discharge unit including a piezoelectric element that is displaced in response to a drive signal, a pressure chamber of which an inner pressure is increased or decreased by the piezoelectric element, and a nozzle which is in communication with the pressure chamber and discharges liquid filling the pressure chamber, depending on an increase or a decrease in the inner pressure of the pressure chamber;

a detection unit that detects residual vibration occurring in the discharge unit according to a potential change of the drive signal that is supplied to the piezoelectric element; and a computer, the control program causing the computer to function as a determination unit that determines a discharge state of liquid in the discharge unit, based on a first detection signal and a second detection signal, the first detection signal being output as a detection result of residual vibration in the discharge unit from a first timing, the first timing being a timing after a potential of the drive signal supplied to the piezoelectric element reaches a first potential from a potential different from the first potential to a second timing, between which the drive signal is kept at the first potential, and the second detection signal being output as a detection result of residual vibration in the discharge unit from a third timing, the third timing being a timing after the potential of the drive signal supplied to the piezoelectric element reaches a second potential from a potential different from the second potential to a fourth timing, between which the drive signal is kept at the second potential.

* * * * *